US010482802B2

(12) United States Patent
Kim et al.

(10) Patent No.: US 10,482,802 B2
(45) Date of Patent: Nov. 19, 2019

(54) DISPLAY APPARATUS HAVING A SHIFT DRIVING MODE AND METHOD OF TESTING THE SAME

(71) Applicant: SAMSUNG DISPLAY CO., LTD., Yongin-si, Gyeonggi-Do (KR)

(72) Inventors: Seonmi Kim, Suwon-si (KR); Changsin Kim, Suwon-si (KR); Changgil Oh, Cheonan-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 146 days.

(21) Appl. No.: 15/454,718

(22) Filed: Mar. 9, 2017

(65) Prior Publication Data

US 2018/0033353 A1 Feb. 1, 2018

(30) Foreign Application Priority Data

Jul. 29, 2016 (KR) ..... 10-2016-0097578

(51) Int. Cl.

| | |
|---|---|
| ***G09G 3/00*** | (2006.01) |
| ***G09G 3/36*** | (2006.01) |
| ***G09G 3/20*** | (2006.01) |

(52) U.S. Cl.

CPC ..... *G09G 3/006* (2013.01); *G09G 3/20* (2013.01); *G09G 3/3677* (2013.01); *G09G 3/3685* (2013.01); *G09G 3/3688* (2013.01); *G09G 2310/0267* (2013.01); *G09G 2310/0286* (2013.01); *G09G 2310/0297* (2013.01); *G09G 2310/08* (2013.01); *G09G 2330/12* (2013.01)

(58) Field of Classification Search

None

See application file for complete search history.

(56) References Cited

U.S. PATENT DOCUMENTS

2006/0050837 A1* 3/2006 Jung ..... G09G 3/3688 377/67

FOREIGN PATENT DOCUMENTS

| | | |
|---|---|---|
| KR | 10-1243793 | 3/2013 |
| KR | 10-2014-0070006 | 6/2014 |

* cited by examiner

*Primary Examiner* — Gustavo Polo

(74) *Attorney, Agent, or Firm* — F. Chau & Associates, LLC

(57) ABSTRACT

A display apparatus includes a display panel configured to display an image. The display panel includes a plurality of gate lines and a plurality of data lines. A gate driving part is configured to output gate signals to the plurality of gate lines. A data driving part includes a plurality of channels configured to output data signals to the plurality of data lines. The plurality of channels is further configured to shift the data signals by M channel, where M is a positive integer, according to a driving mode selection signal for selecting a driving mode of the display panel.

20 Claims, 26 Drawing Sheets

DISPLAY APPARATUS HAVING A SHIFT DRIVING MODE AND METHOD OF TESTING THE SAME

CROSS-REFERENCE TO RELATED APPLICATION

This application claims priority under 35 U.S.C. § 119 to Korean Patent Application No. 10-2016-0097578, filed on Jul. 29, 2016 in the Korean Intellectual Property Office (KIPO), the contents of which are herein incorporated by reference in their entireties.

TECHNICAL FIELD

Exemplary embodiments of the present inventive concept relate to a display apparatus, and more particularly to a display apparatus having a shift driving mode and a method of testing the display apparatus.

DISCUSSION OF THE RELATED ART

Many mobile electronic devices such as cellular phones, smartphones, Personal Digital Assistants (PDA), tablet computers, personal computers, notebook computers, and wearable devices utilize a display apparatus for displaying images. Such a display apparatus includes a Liquid Crystal Display (LCD), a Plasma Display Panel (PDP), a Field Emission Display (FED), an Organic Light Emitting Diode (OLED) display apparatus, etc.

The display apparatus includes a display panel displaying an image, and a display panel driving apparatus driving the display panel.

The display panel includes gate lines, data lines, and pixels that are electrically connected to each of the gate lines and each of the data lines.

The display panel driving apparatus includes a gate driving part outputting gate signals to the gate lines, and a data driving part outputting data signals to the data lines.

After the display apparatus is manufactured, a test process is performed thereon. The test process may be used for checking whether a defect is present in the display panel.

When a defect is detected during the performance of the test process of the display apparatus, the defect may be caused by either a fault in the display panel, or an element of the display panel driving apparatus. When the defect is in an element of the driving apparatus, efficiency of the test process is decreased.

SUMMARY OF THE INVENTIVE CONCEPT

A display apparatus includes a display panel configured to display an image. The display panel includes a plurality of gate lines and a plurality of data lines. A gate driving part is configured to output gate signals to the plurality of gate lines. A data driving part includes a plurality of channels configured to output data signals to the plurality of data lines. The plurality of channels is further configured to shift the data signals by M channel, where M is a positive integer, according to a driving mode selection signal for selecting a driving mode of the display panel.

A method of testing a display apparatus includes operating a data driving part of a display panel in a normal driving mode in which data signals are output to data lines of the display panel configured to display an image and operating the data driving part of the display panel in a shift driving mode in which the data signals are shifted by M channel prior to outputting the data signals. Here M is a positive integer. It is determined whether a defect present in the image displayed on the display panel is due to a fault of the display panel or is due to a fault of the data driving part which outputs the data signals to the display panel.

A method for testing a display apparatus includes operating a data driver of the display apparatus in a first mode in which data signals are provided to data lines of the display apparatus with a first correspondence and determining a first location of a defect displayed in the display apparatus while operating the data driver in the first mode. The data driver of the display apparatus is operated in a second mode in which the data signals are provided to the data lines of the display apparatus with a second correspondence that is different from the first correspondence and a second location of the defect displayed in the display apparatus is determined while operating the data driver in the second mode. It is determined whether a fault is present in the data driver or a display panel of the display apparatus based on whether the first location and the second location are identical to each other.

BRIEF DESCRIPTION OF THE DRAWINGS

The above and other features and aspects of the present inventive concept will become more apparent by describing in detailed exemplary embodiments thereof with reference to the accompanying drawings, in which.

DETAILED DESCRIPTION OF THE INVENTIVE CONCEPT

Hereinafter, the present inventive concept will be explained in detail with reference to the accompanying drawings.

Figure 1:
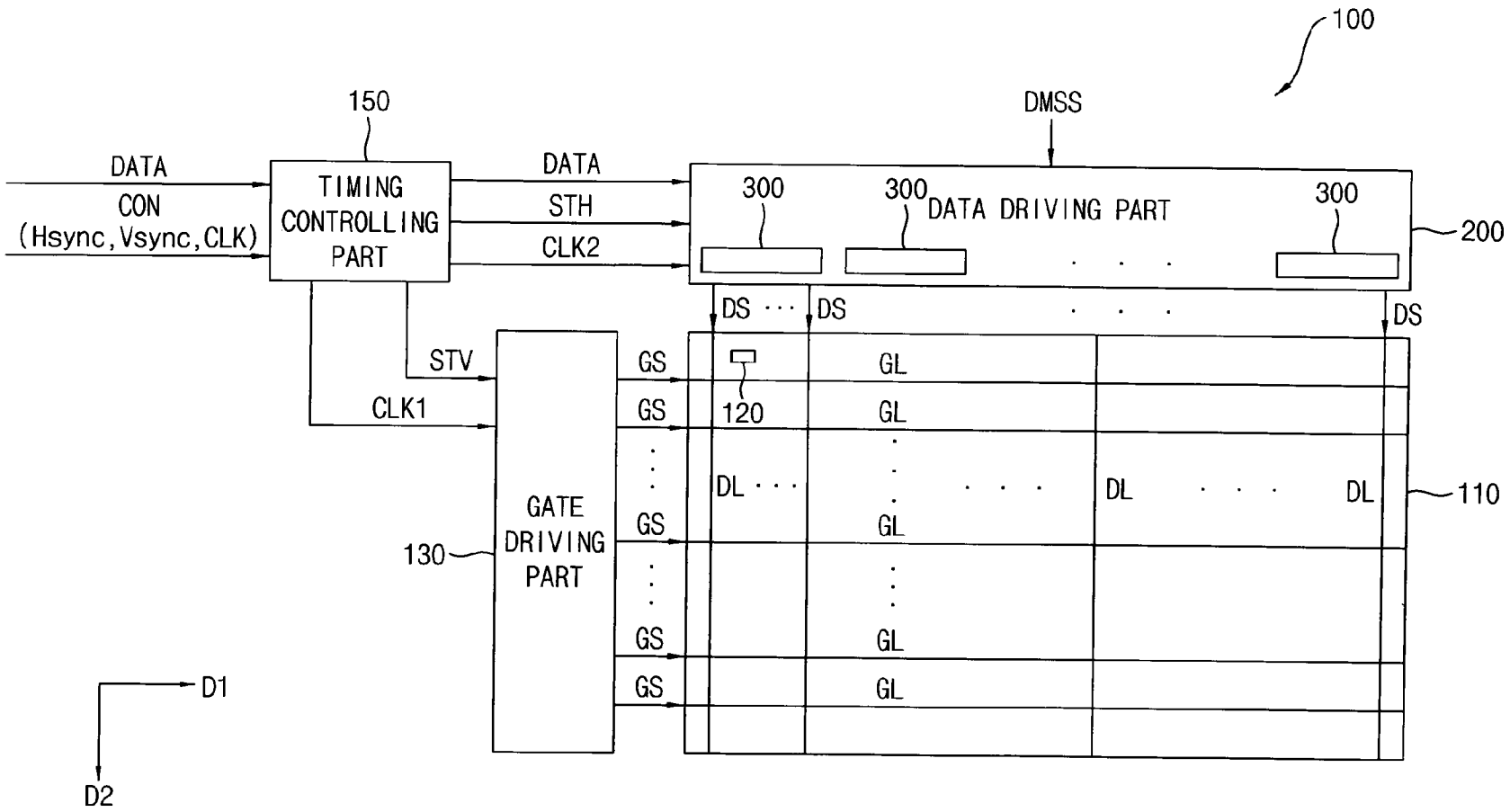
FIG. 1 is a block diagram illustrating a display apparatus according to an exemplary embodiment of the present inventive concept.

FIG. 1 is a block diagram illustrating a display apparatus according to an exemplary embodiment of the present inventive concept.

Referring to FIG. 1, the display apparatus 100, according to an exemplary embodiment of the present inventive concept, includes a display panel 110, a gate driving part 130, a data driving part 200 and a timing controlling part 150.

The display panel 110 receives a data signal DS from the data driving part 200 to display an image. The display panel 110 includes gate lines GL, data lines DL and pixels 120. A pixel 120 may be disposed at each location where the gate lines GL cross the display lines DL. The gate lines GL extend in a first direction D1 and are arranged in a second direction D2 substantially perpendicular to the first direction D1. The data lines DL extend in the second direction D2 and are arranged in the first direction D1. Here, the first direction D1 may be parallel to a long side of the display panel 110, and the second direction D2 may be parallel to a short side of the display panel 110.

Figure 2:
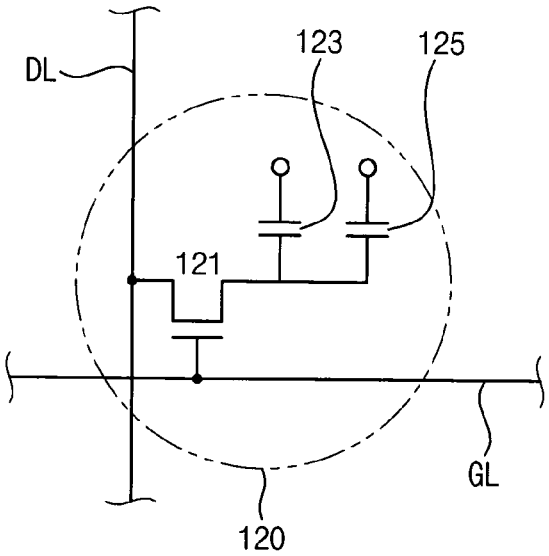
FIG. 2 is a circuit diagram illustrating a pixel of FIG. 1.

FIG. 2 is a circuit diagram illustrating the pixel 120 of FIG. 1.

Referring to FIGS. 1 and 2, each of the pixels 120 receives one of the gate lines GL and one of the data lines DL. For example, the pixel 120 may include a thin film transistor 121 electrically connected to the gate line GL and the data line DL, a liquid crystal capacitor 123, and a storage capacitor 125 connected to the thin film transistor 121. Thus, the display panel 110 may be a liquid crystal display panel.

Referring to FIG. 1 again, the gate driving part 130, the data driving part 200 and the timing controlling part 150 may be defined as a display panel driving apparatus for driving the display panel 110.

The gate driving part 130 generates gate signals GS in response to a vertical start signal STV and a first clock signal CLK1 provided from the timing controlling part 150, and outputs the gate signals GS to the gate lines GL.

The data driving part 200 receives image data DATA from the timing controlling part 150, generates the data signal DS based on the image data DATA, and outputs the data signal DS to the data line DL in response to a horizontal start signal STH and a second clock signal CLK2 provided from the timing controlling part 150. The data driving part 200 may include a plurality of data driving integrated circuits 300 which output the data signals DS.

The data driving part 200 receives a driving mode selection signal DMSS from an outside source. The driving mode selection signal DMSS may be a signal for determining whether the display panel 110 is driven in a normal mode or the display panel 110 is driven in a shift mode. When the data driving part 200 drives the display panel 110 in the normal driving mode, the data driving part 200 outputs the data signals DS to the data lines DL, respectively. When the data driving part 200 drives the display panel 110 in the shift driving mode, the data driving part 200 shifts the data signals DS in one or more data line unit, and outputs the data signals DS.

The timing controlling part 150 receives the image data DATA and a control signal CON from an outside source. The control signal CON may include a horizontal synchronous signal Hsync, a vertical synchronous signal Vsync and a clock signal CLK. The timing controlling part 150 generates the horizontal start signal STH using the horizontal synchronous signal Hsync and outputs the horizontal start signal STH to the data driving part 200. In addition, the timing controlling part 150 generates the vertical start signal STV using the vertical synchronous signal Vsync and outputs the vertical start signal STV to the gate driving part 130. In addition, the timing controlling part 150 generates the first clock signal CLK1 and the second clock signal CLK2 using the clock signal CLK, outputs the first clock signal CLK1 to the gate driving part 130, and outputs the second clock signal CLK2 to the data driving part 200.

Figure 3:
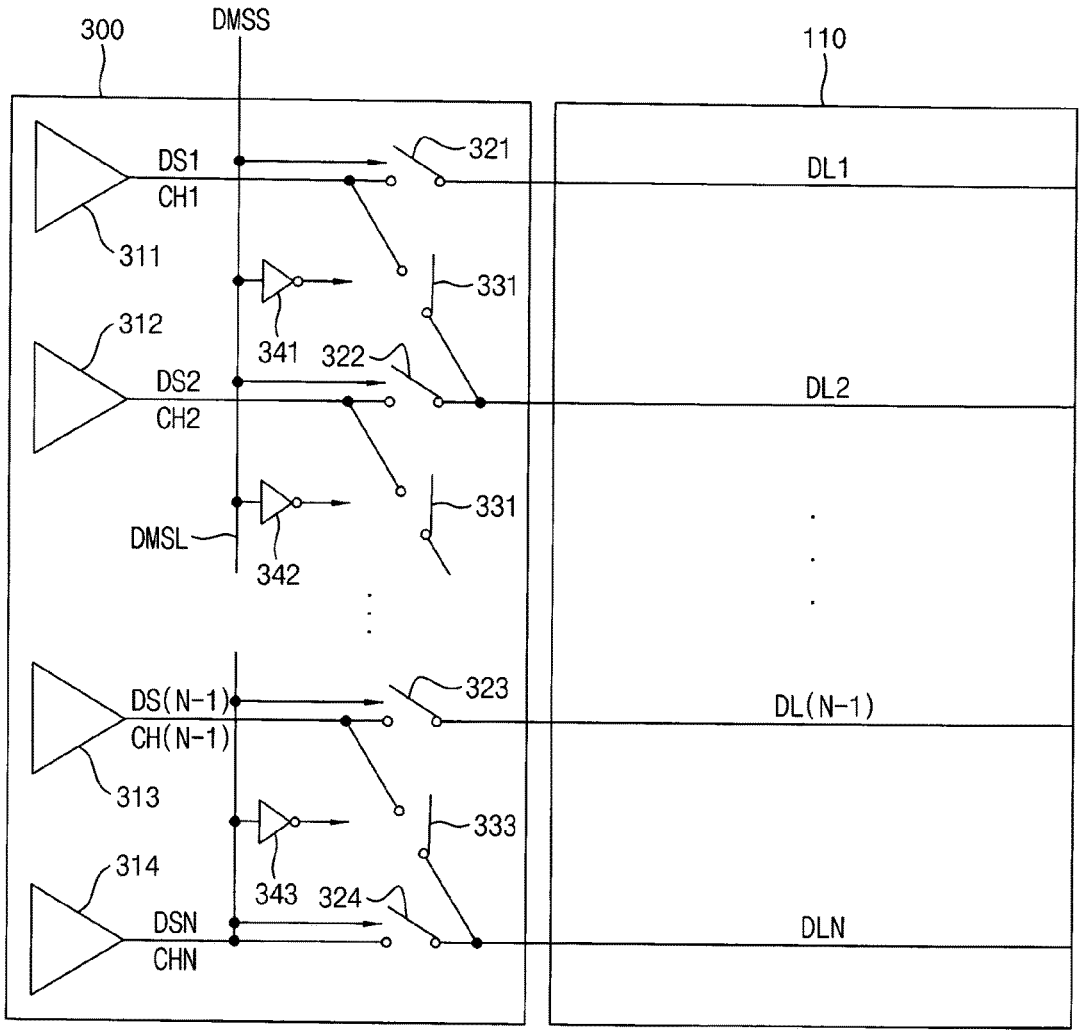
FIG. 3 is a block diagram illustrating a data driving integrated circuit of FIG. 1 and a display panel of FIG. 1.

FIG. 3 is a block diagram illustrating the data driving integrated circuit 300 of FIG. 1 and the display panel 110 of FIG. 1.

Referring to FIGS. 1 and 3, the data driving integrated circuits 300 each include first to N-th buffers 311, 312, 313 and 314, first to N-th normal driving switches 321, 322, 323 and 324, first to (N−1)-th shift driving switches 331, 332 and 333, first to (N−1)-th inverters 341, 342 and 343, and a driving mode selection line DMSL.

The first to N-th buffers 311, 312, 313 and 314 output first to N-th data signals DS1, DS2, DS(N−1) and DSN through first to N-th channels CH1, CH2, CH(N−1) and CHN, respectively. The first to N-th channels CH1, CH2, CH(N−1) and CHN may be respectively connected to first to N-th data lines DL1, DL2, DL(N−1) and DLN of the data lines DL of FIG. 1. The first to N-th data signals DS1, DS2, DS(N−1) and DSN may be included in the data signals DS of FIG. 1.

The first to N-th normal driving switches 321, 322, 323 and 324 are disposed on the first to N-th channels CH1, CH2, CH(N−1) and CHN, respectively. The first to N-th normal driving switches 321, 322, 323 and 324 connect or disconnect the first to N-th channels CH1, CH2, CH(N−1) and CHN, respectively.

A first shift driving switch 331 is disposed between a first channel CH1 and a second channel CH2. The first shift driving switch 331 connects or disconnects between the first channel CH1 and the second channel CH2. A second shift driving switch 332 is disposed between the second channel CH2 and a third channel. The second shift driving switch 332 connects or disconnects between the second channel CH2 and the third channel. Similarly, an (N−1)-th shift driving switch 333 is disposed between an (N−1)-th channel and an N-th channel CHN. The (N−1)-th shift driving switch 333 connects or disconnects between the (N−1)-th channel and the N-th channel CHN.

The driving mode selection signal DMSS is transferred to the driving mode selection line DMSL. The driving mode selection signal DMSS is applied to each of the first to N-th normal driving switches 321, 322, 323 and 324.

The first to (N−1)-th inverters 341, 342 and 343 are disposed between the driving mode selection line DMSL and the first to (N−1)-th shift driving switches 331, 332 and 333. For example, a first inverter 341 is disposed between the driving mode selection line DMSL and the first shift driving switch 331. A second inverter 342 is disposed between the driving mode selection line DMSL and the second shift driving switch 332. An (N−1)-th inverter 343 is disposed between the driving mode selection line DMSL and the (N−1)-th shift driving switch 333.

For example, when the driving mode selection signal DMSS is at a first level, each of the first to N-th normal driving switches 321, 322, 323 and 324 may be closed, and each of the first to (N−1)-th shift driving switches 331, 332 and 333 may be opened. In addition, when the driving mode selection signal DMSS is at a second level, that is different from the first level, each of the first to N-th normal driving switches 321, 322, 323 and 324 may be opened, and each of the first to (N−1)-th shift driving switches 331, 332 and 333 may be closed. For example, the first level may be a low level, and the second level may be a high level.

The data driving integrated circuit 300 performs normal driving in which the data driving part 300 outputs the first to N-th data signals DS1, DS2, DS(N−1) and DSN to the first to N-th data lines DL1, DL2, DL(N−1) and DLN, respectively, according to the first level of the driving mode selection signal DMSS. In addition, the data driving integrated circuit 300 performs shift driving in which the data driving part 300 shifts first to (N−1)-th data signals DS1, DS2 and DS(N−1) among the first to N-th data signals DS1, DS2, DS(N−1) and DSN by one channel to output the first to (N−1)-th data signals DS1, DS2 and DS(N−1), according to the second level of the driving mode selection signal DMSS. In this case, the data driving integrated circuit 300 may shift the first to (N−1)-th data signals DS1, DS2 and DS(N−1) by one channel in a direction in which the first to N-th data lines DL1, DL2, DL(N−1) and DLN are sequentially arranged.

Figure 4A:
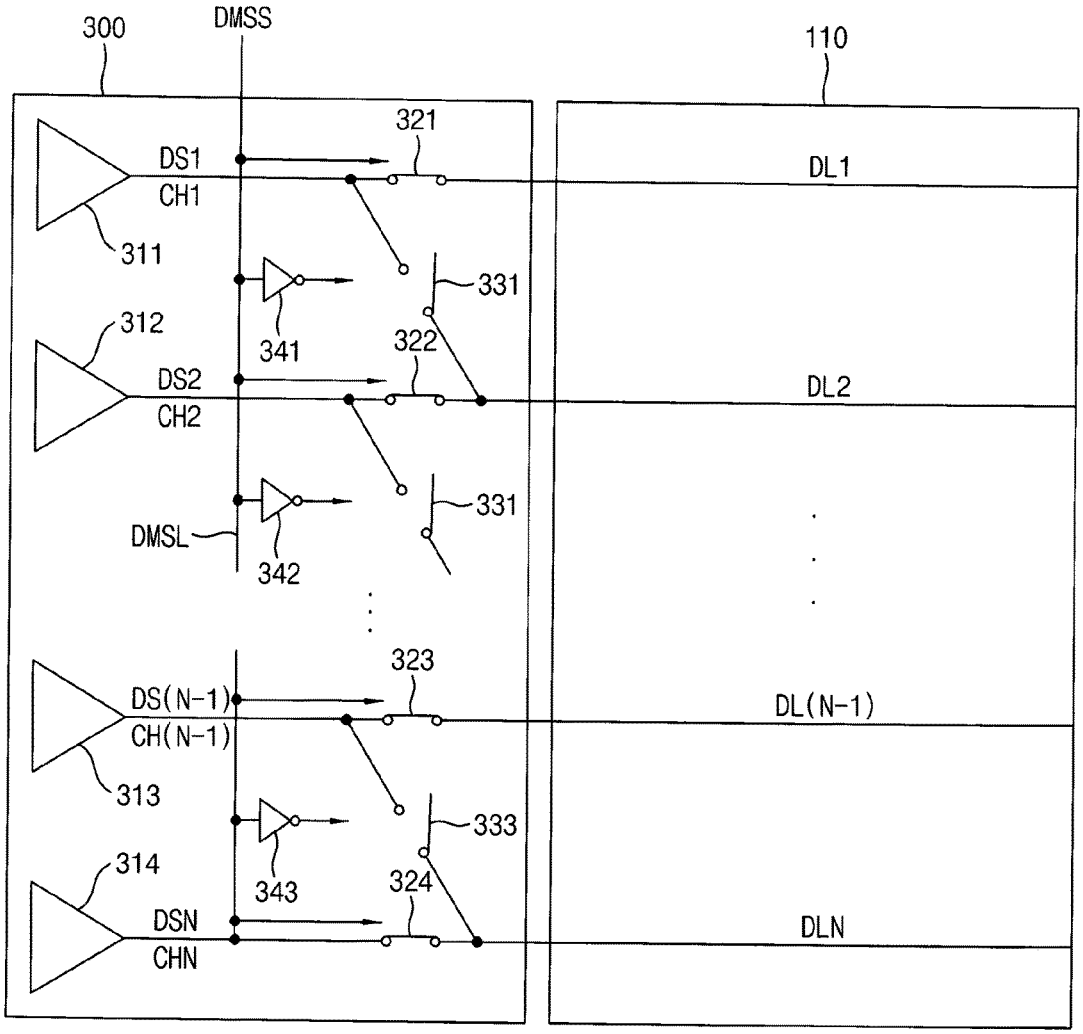
FIG. 4A is a block diagram illustrating a data driving integrated circuit and the display panel when a driving mode selection signal of FIGS. 1 and 3 is at a first level.

FIG. 4A is a block diagram illustrating the data driving integrated circuit 300 and the display panel 110 when the driving mode selection signal DMSS of FIGS. 1 and 3 is the first level.

Referring to FIGS. 1, 3 and 4A, when the driving mode selection signal DMSS is the first level, each of the first to N-th normal driving switches 321, 322, 323 and 324 may be closed, and each of the first to (N−1)-th shift driving switches 331, 332 and 333 may be opened. Therefore, the data driving integrated circuit 300 may output the first to N-th data signals DS1, DS2, DS(N−1) and DSN to the first to N-th data lines DL1, DL2, DL(N−1) and DLN, respectively.

Figure 4B:
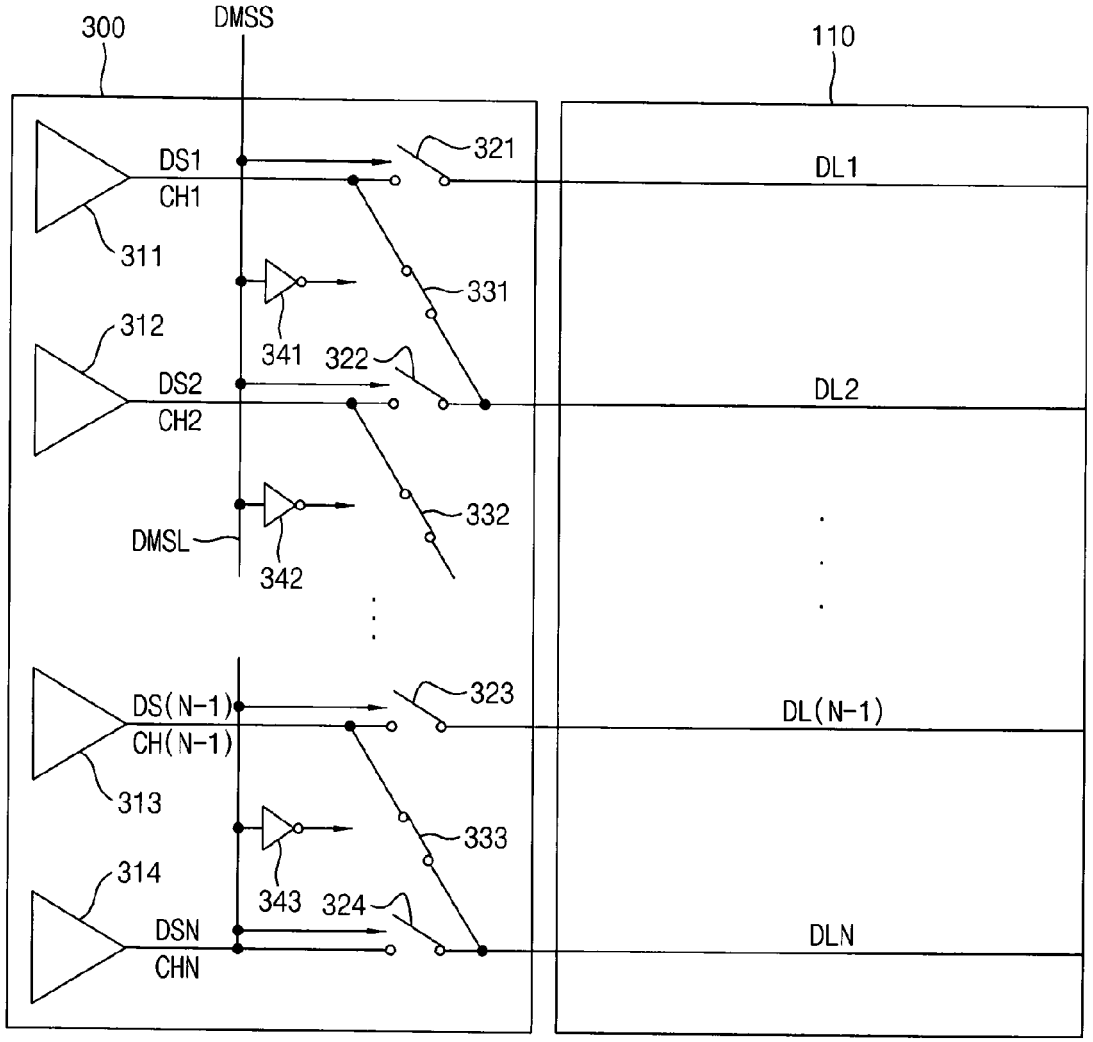
FIG. 4B is a block diagram illustrating the data driving integrated circuit and the display panel when the driving mode selection signal of FIGS. 1 and 3 is at a second level.

FIG. 4B is a block diagram illustrating the data driving integrated circuit 300 and the display panel 110 when the driving mode selection signal DMSS of FIGS. 1 and 3 is at the second level.

Referring to FIGS. 1, 3 and 4B, when the driving mode selection signal DMSS is at the second level, each of the first to N-th normal driving switches 321, 322, 323 and 324 may be opened, and each of the first to (N−1)-th shift driving switches 331, 332 and 333 may be closed. Therefore, the data driving integrated circuit 300 shifts the first to (N−1)-th data signals DS1, DS2 and DS(N−1) by one channel in the direction in which the first to N-th data lines DL1, DL2, DL(N−1) and DLN are sequentially arranged to output the first to (N−1)-th data signals DS1, DS2 and DS(N−1). For example, the data driving integrated circuit 300 outputs a first data signal DS1 to a second data line DL2. In addition, the data driving integrated circuit 300 outputs a second data signal DS2 to a third data line. Similarly, the data driving integrated circuit 300 may output an (N−1)-th data signal DS(N−1) to an N-th data line DLN. In this case, a dummy data signal may be applied to a first data line DL1.

Figure 5A:
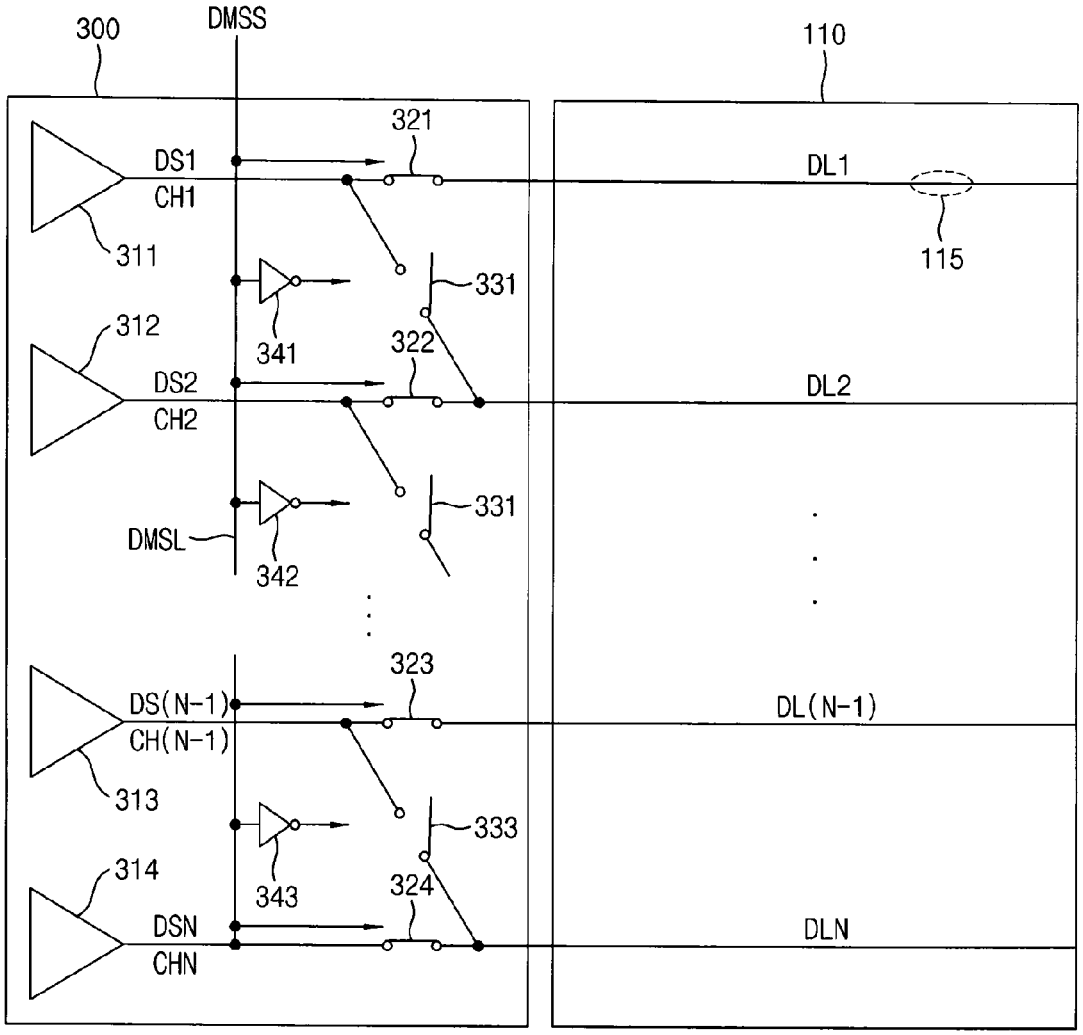
FIG. 5A is a block diagram illustrating the data driving integrated circuit and the display panel of FIG. 3 when fault is generated in the display panel and the data driving integrated circuit performs normal driving.

FIG. 5A is a block diagram illustrating the data driving integrated circuit 300 and the display panel 110 of FIG. 3 when a fault is generated in the display panel 110 and the data driving integrated circuit 300 performs normal driving.

Referring to FIGS. 1 and 3 to 5A, according to exemplary embodiments of the present invention, the fault may be generated in the first data line DL1 of the display panel 110. In this case, when the data driving integrated circuit 300 performs normal driving in which the data driving integrated circuit 300 outputs the first to N-th data signals DS1, DS2, DS(N−1) and DSN to the first to N-th data lines DL1, DL2, DL(N−1) and DLN, respectively, a defect 115 may be displayed on the first data line DL1 of the display panel 110.

Figure 5B:
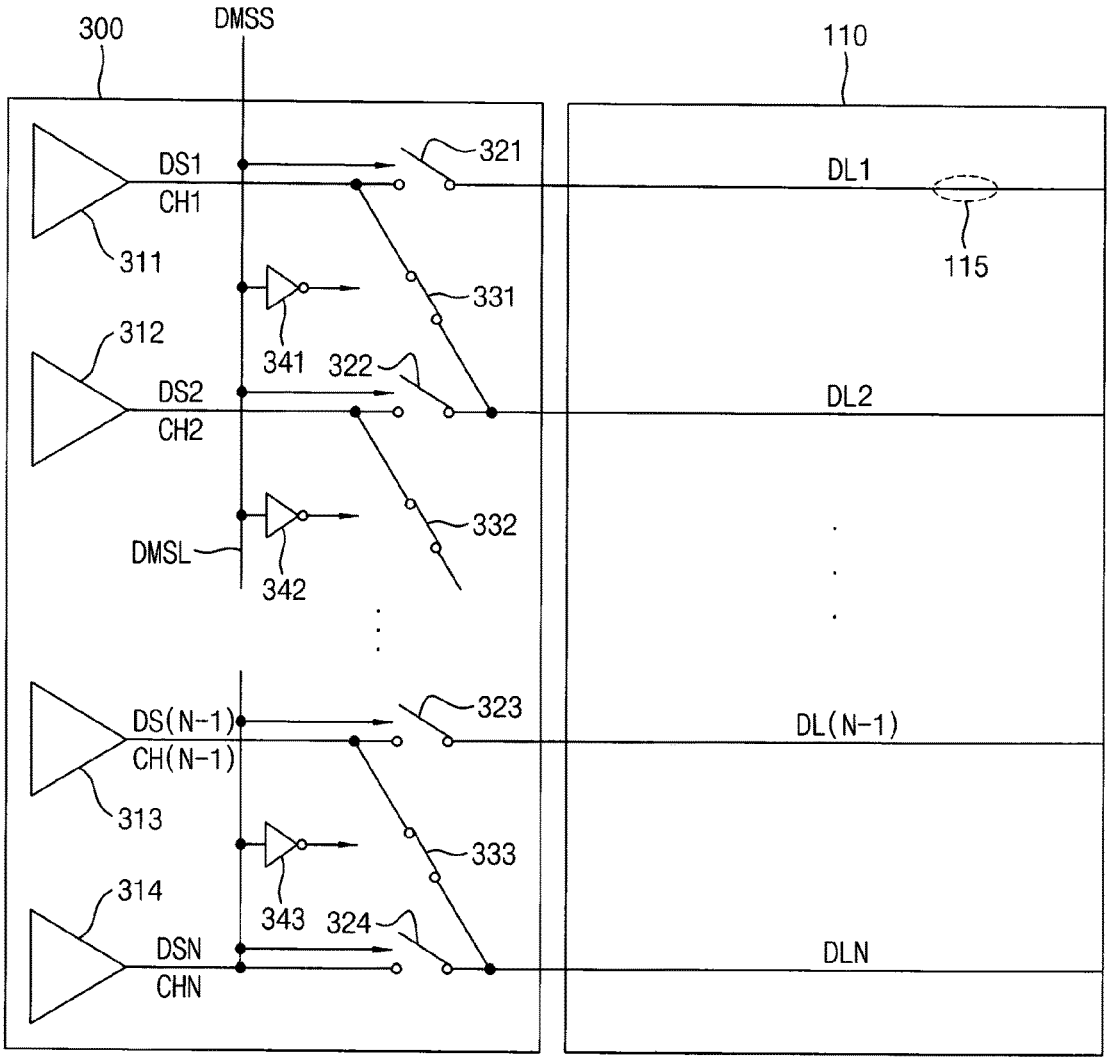
FIG. 5B is a block diagram illustrating the data driving integrated circuit and the display panel of FIG. 3 when the fault is generated in the display panel and the data driving integrated circuit performs shift driving.

FIG. 5B is a block diagram illustrating the data driving integrated circuit 300 and the display panel 110 of FIG. 3 when the fault is generated in the display panel 110 and the data driving integrated circuit 300 performs shift driving.

Referring to FIGS. 1, 3, 4 and 5B, according to exemplary embodiments of the present invention, the fault may be generated in the first data line DL1 of the display panel 110. In this case, when the data driving integrated circuit 300 performs shift driving in which the data driving integrated circuit 300 shifts the first to (N−1)-th data signals DS1, DS2 and DS(N−1) by one channel and outputs the first to (N−1)-th data signals DS1, DS2 and DS(N−1), since the fault is generated in the first data line DL1, the defect 115 may be displayed on the first data line DL1 of the display panel 110.

As described above, when the fault is generated in the display panel 110, a position of the defect 115 in the image displayed on the display panel 110 does not change as the data driving integrated circuit 300 switches between normal driving and shift driving.

Figure 5C:
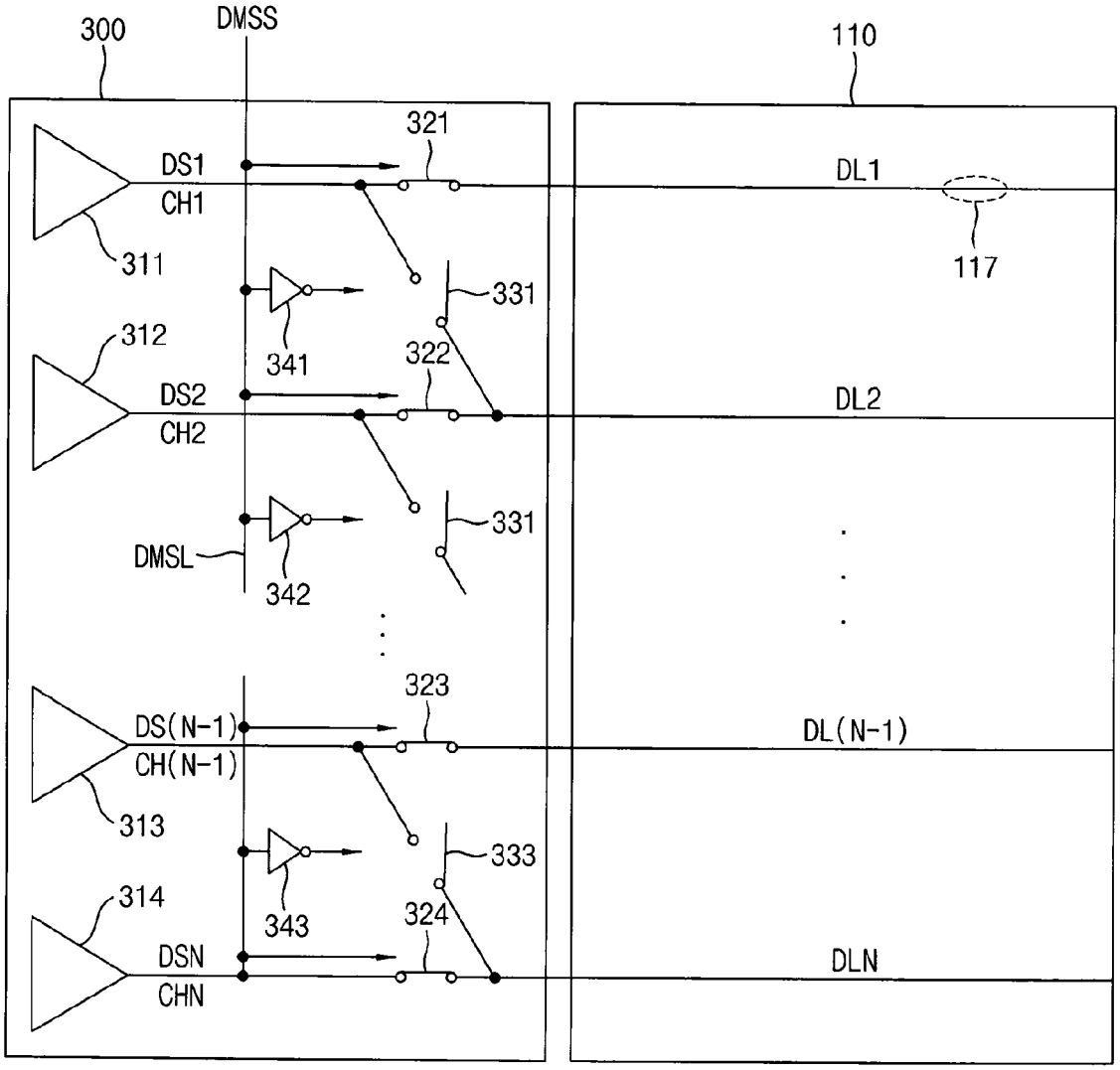
FIG. 5C is a block diagram illustrating the data driving integrated circuit and the display panel of FIG. 3 when fault is generated in the data driving integrated circuit and the data driving integrated circuit performs normal driving.

FIG. 5C is a block diagram illustrating the data driving integrated circuit 300 and the display panel 110 of FIG. 3 when fault is generated in the data driving integrated circuit 300 and the data driving integrated circuit 300 performs normal driving.

Referring to FIGS. 1, 3, 4 and 5C, according to exemplary embodiments of the present invention, a fault may be generated in a first buffer 311 in the data driving integrated circuit 300. In this case, when the data driving integrated circuit 300 performs normal driving, in which the data driving integrated circuit 300 outputs the first to N-th data signals DS1, DS2, DS(N−1) and DSN to the first to N-th data lines DL1, DL2, DL(N−1) and DLN, respectively, a defect 117 may be displayed on the first data line DL1 of the display panel 110.

Figure 5D:
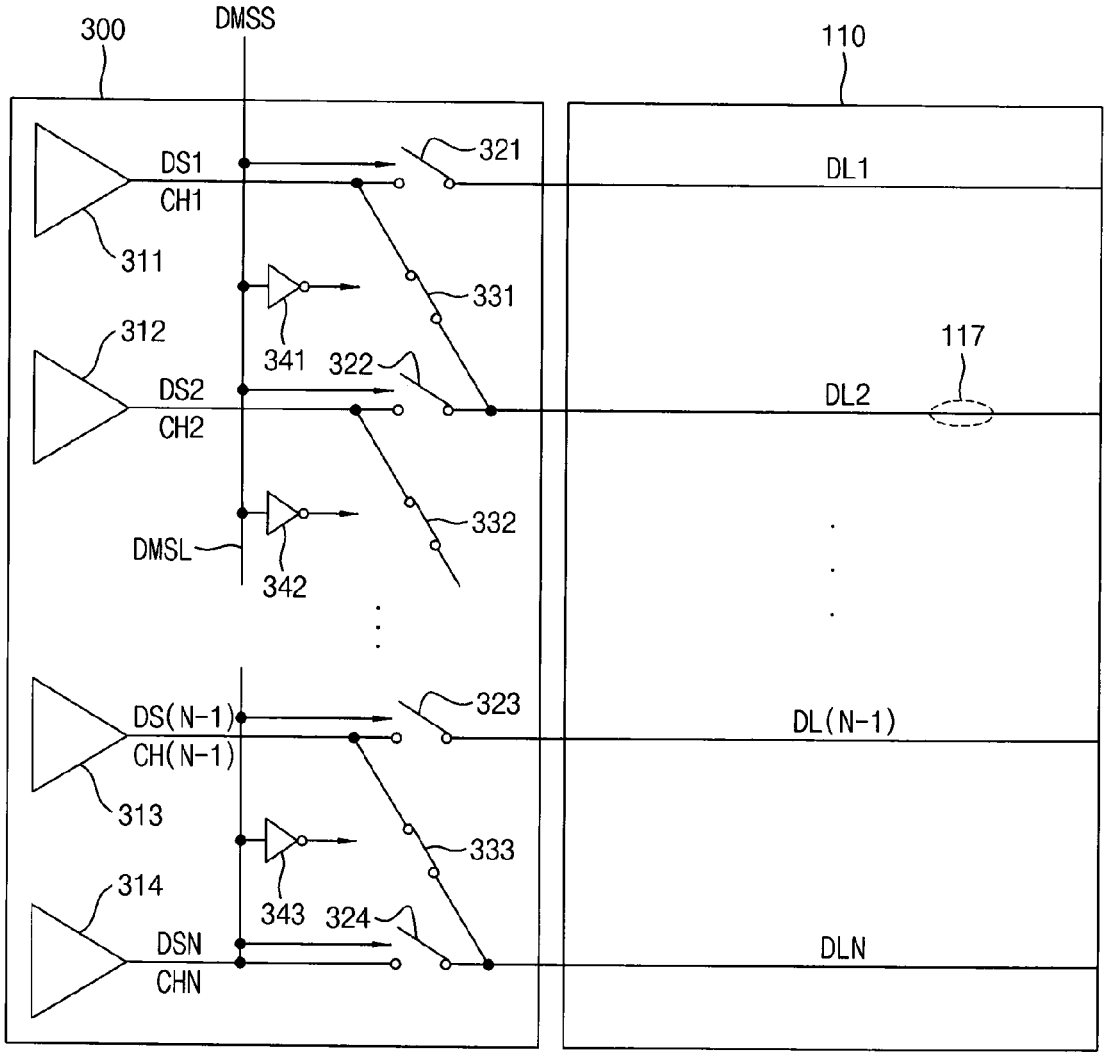
FIG. 5D is a block diagram illustrating the data driving integrated circuit and the display panel of FIG. 3 when the fault is generated in the data driving integrated circuit and the data driving integrated circuit performs shift driving.

FIG. 5D is a block diagram illustrating the data driving integrated circuit 300 and the display panel 110 of FIG. 3 when the fault is generated in the data driving integrated circuit 300 and the data driving integrated circuit 300 performs shift driving.

Referring to FIGS. 1, 3, 4 and 5D, according to exemplary embodiments of the present invention, the fault may be generated in the first buffer 311 in the data driving integrated circuit 300. In this case, when the data driving integrated circuit 300 performs shift driving in which the data driving integrated circuit 300 shifts the first to (N−1)-th data signals DS1, DS2 and DS(N−1) by one channel and outputs the first to (N−1)-th data signals DS1, DS2 and DS(N−1), since the fault is generated in the first buffer 311, the defect 117 may be displayed on the second data line DL2 of the display panel 110.

As described above, when the fault is generated in the data driving integrated circuit 300 of the data driving part 200, a position of the defect 117 in the image displayed on the display panel 110 changes from when the data driving integrated circuit 300 performs normal driving and when the data driving integrated circuit 300 performs shift driving.

Thus, in a test process of the display apparatus 100, when the display panel 110 displays the defect, it may be easily and quickly determined whether the defect is caused by the fault of the display panel 110 or the defect is caused by the fault of the data driving part 200.

Figure 6:
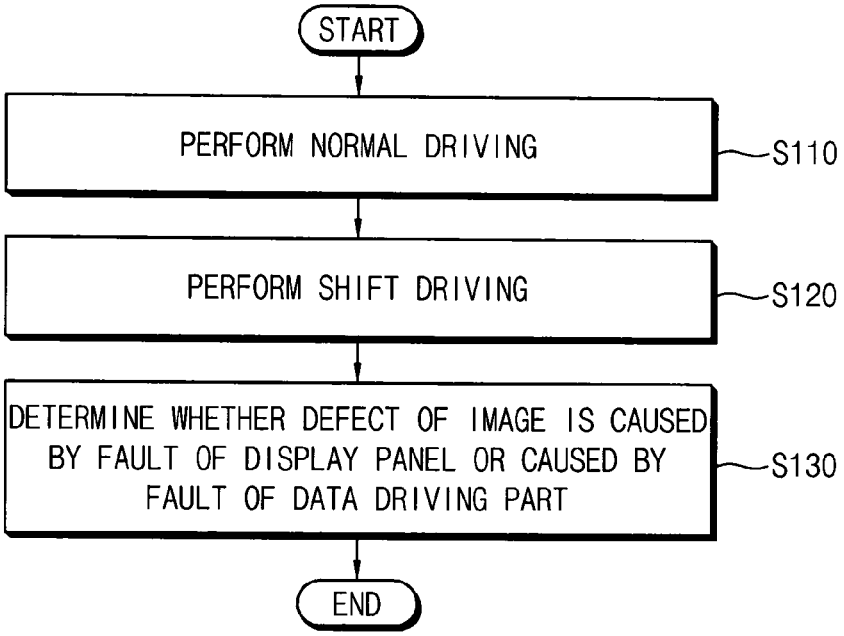
FIG. 6 is a flow chart illustrating a method of testing the display apparatus of FIG. 1.

FIG. 6 is a flow chart illustrating a method of testing the display apparatus 100 of FIG. 1 in accordance with exemplary embodiments of the present inventive concept.

Referring to FIGS. 1 and 3 to 6, normal driving is performed (step S110). For example, each of the first to N-th normal driving switches 321, 322, 323 and 324 may be closed, and each of the first to (N−1)-th shift driving switches 331, 332 and 333 may be opened, according to the first level of the driving mode selection signal DMSS. Therefore, the data driving integrated circuit 300 may output the first to N-th data signals DS1, DS2, DS(N−1) and DSN to the first to N-th data lines DL1, DL2, DL(N−1) and DLN.

Shift driving is performed (step S120). For example, each of the first to N-th normal driving switches 321, 322, 323 and 324 may be opened, and each of the first to (N−1)-th shift driving switches 331, 332 and 333 may be closed, according to the second level of the driving mode selection signal DMSS. Therefore, the data driving integrated circuit 300 shifts the first to (N−1)-th data signals DS1, DS2 and DS(N−1) by one channel and outputs the first to (N−1)-th data signals DS1, DS2 and DS(N−1). For example, the data driving integrated circuit 300 outputs the first data signal DS1 to the second data line DL2. In addition, the data driving integrated circuit 300 outputs the second data signal DS2 to the third data line. Similarly, the data driving integrated circuit 300 may output the (N−1)-th data signal DS(N−1) to the N-th data line DLN. In this case, the dummy data signal may be applied to the first data line DL1.

It is then determined whether the defect of the image is caused by the fault of the display panel 110 or the defect is caused by the fault of the data driving part 200 (step S130). For example, when the fault is generated in the display panel 110, the position of the defect 115 in the image displayed on the display panel 110 does not change as the data driving integrated circuit 300 changes from normal driving to shift driving. When the fault is generated in the data driving integrated circuit 300 of the data driving part 200, the position of the defect 117 in the image displayed on the display panel 110 changes as the data driving integrated circuit 300 changes from normal driving to shift driving.

Thus, in the test process of the display apparatus 100, when the display panel 110 displays the defect, it may be easily and quickly determined whether the defect is caused by the fault of the display panel 110 or the defect is caused by the fault of the data driving part 200. Moreover, this determination may be made without having to separate the data driving integrated circuit 300 from the data driving part 200.

Figure 7:
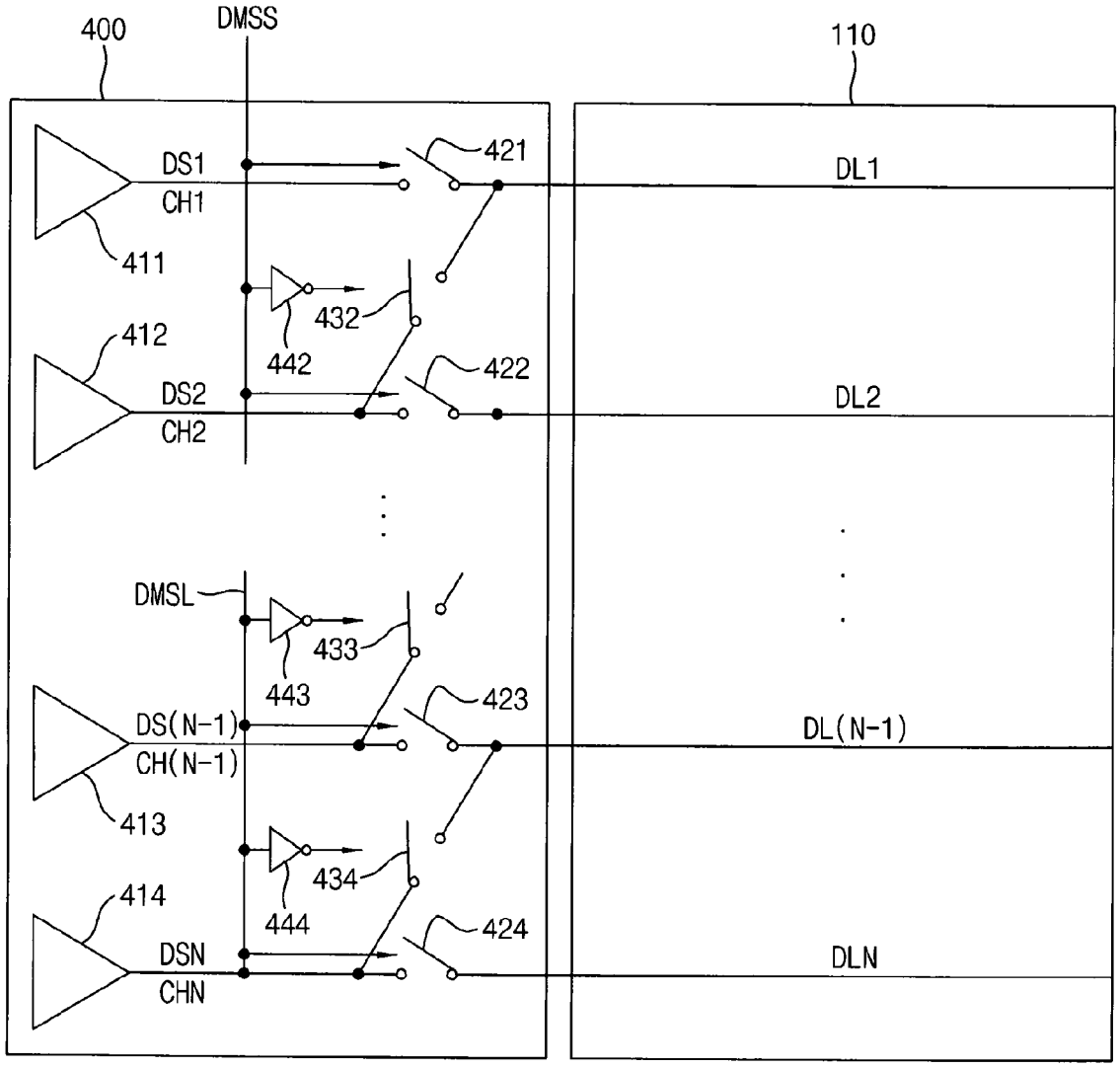
FIG. 7 is a block diagram illustrating a data driving integrated circuit and a display panel according to an exemplary embodiment of the present inventive concept.

FIG. 7 is a block diagram illustrating a data driving integrated circuit and a display panel according to an exemplary embodiment of the present inventive concept.

The data driving integrated circuit 400 illustrated in FIG. 7, according to an exemplary embodiment of the present invention, may be included in the data driving part 200 illustrated in FIG. 1. In addition, the display panel 110 illustrated in FIG. 7 may be substantially the same as the display panel 110 illustrated in FIGS. 1 and 3. Thus, the same reference numerals may be used to refer to same or like parts as those described above and it may be assumed that any omitted details may be substantially the same as those previously described.

Referring to FIGS. 1 and 7, the data driving integrated circuit 400 includes first to N-th buffers 411, 412, 413 and 414, first to N-th normal driving switches 421, 422, 423 and 424, second to N-th shift driving switches 432, 433 and 434, second to N-th inverters 442, 443 and 444, and a driving mode selection line DMSL.

The first to N-th buffers 411, 412, 413 and 414 output first to N-th data signals DS1, DS2, DS(N−1) and DSN through first to N-th channels CH1, CH2, CH(N−1) and CHN, respectively. The first to N-th channels CH1, CH2, CH(N−1) and CHN may be respectively connected to first to N-th data lines DL1, DL2, DL(N−1) and DLN of the data lines DL of FIG. 1. The first to N-th data signals DS1, DS2, DS(N−1) and DSN may be included in the data signals DS of FIG. 1.

The first to N-th normal driving switches 421, 422, 423 and 424 are disposed on the first to N-th channels CH1, CH2, CH(N−1) and CHN, respectively. The first to N-th normal driving switches 421, 422, 423 and 424 connect or disconnect the first to N-th channels CH1, CH2, CH(N−1) and CHN, respectively.

An N-th shift driving switch 434 of the second to N-th shift driving switches 432, 433 and 434 is disposed between an N-th channel CHN and an (N−1)-th channel CH(N−1). The N-th shift driving switch 434 connects or disconnects between the N-th channel CHN and the (N−1)-th channel CH(N−1). An (N−1)-th shift driving switch 433 of the second to N-th shift driving switches 432, 433 and 434 is disposed between the (N−1)-th channel CH(N−1) and an (N−2)-th channel. The (N−1)-th shift driving switch 433 connects or disconnects the (N−1)-th channel CH(N−1) and the (N−2)-th channel. Similarly, a second shift driving switch 432 of the second to N-th shift driving switches 432, 433 and 434 is disposed between a second channel CH2 and a first channel CH1. The second shift driving switch 432 connects or disconnects the second channel CH2 and the first channel CH1.

The driving mode selection signal DMSS is transferred to the driving mode selection line DMSL. The driving mode selection signal DMSS is applied to each of the first to N-th normal driving switches 421, 422, 423 and 424.

The second to N-th inverters 442, 443 and 444 are disposed between the driving mode selection line DMSL and the second to N-th shift driving switches 432, 433 and 434. For example, a second inverter 442 of the second to N-th inverters 442, 443 and 444 is disposed between the driving mode selection line DMSL and the second shift driving switch 432. An (N−1)-th inverter 443 of the second to N-th inverters 442, 443 and 444 is disposed between the driving mode selection line DMSL and the (N−1)-th shift driving switch 433. An N-th inverter 444 of the second to N-th inverters 442, 443 and 444 is disposed between the driving mode selection line DMSL and the N-th shift driving switch 434.

For example, when the driving mode selection signal DMSS is at a first level, each of the first to N-th normal driving switches 421, 422, 423 and 424 may be closed, and each of the second to N-th shift driving switches 432, 433 and 434 may be opened. In addition, when the driving mode selection signal DMSS is at a second level, that is different from the first level, each of the first to N-th normal driving switches 421, 422, 423 and 424 may be opened, and each of the second to N-th shift driving switches 432, 433 and 434 may be closed. For example, the first level may be a low level, and the second level may be a high level.

The data driving integrated circuit 400 performs normal driving in which the data driving part 400 outputs the first to N-th data signals DS1, DS2, DS(N−1) and DSN to the first to N-th data lines DL1, DL2, DL(N−1) and DLN, respectively, according to the first level of the driving mode selection signal DMSS. In addition, the data driving integrated circuit 400 performs shift driving in which the data driving part 400 shifts N-th to second data signals DSN, DS(N−1) and DS2 of N-th to first data signals DSN, DS(N−1), DS2 and DS1 by one channel to output the N-th to second data signals DSN, DS(N−1) and DS2, according to the second level of the driving mode selection signal DMSS. In this case, the data driving integrated circuit 400 may shift the N-th to second data signals DSN, DS(N−1) and DS2 by one channel in a direction opposite to a direction in which the first to N-th data lines DL1, DL2, DL(N−1) and DLN are sequentially arranged.

Figure 8A:
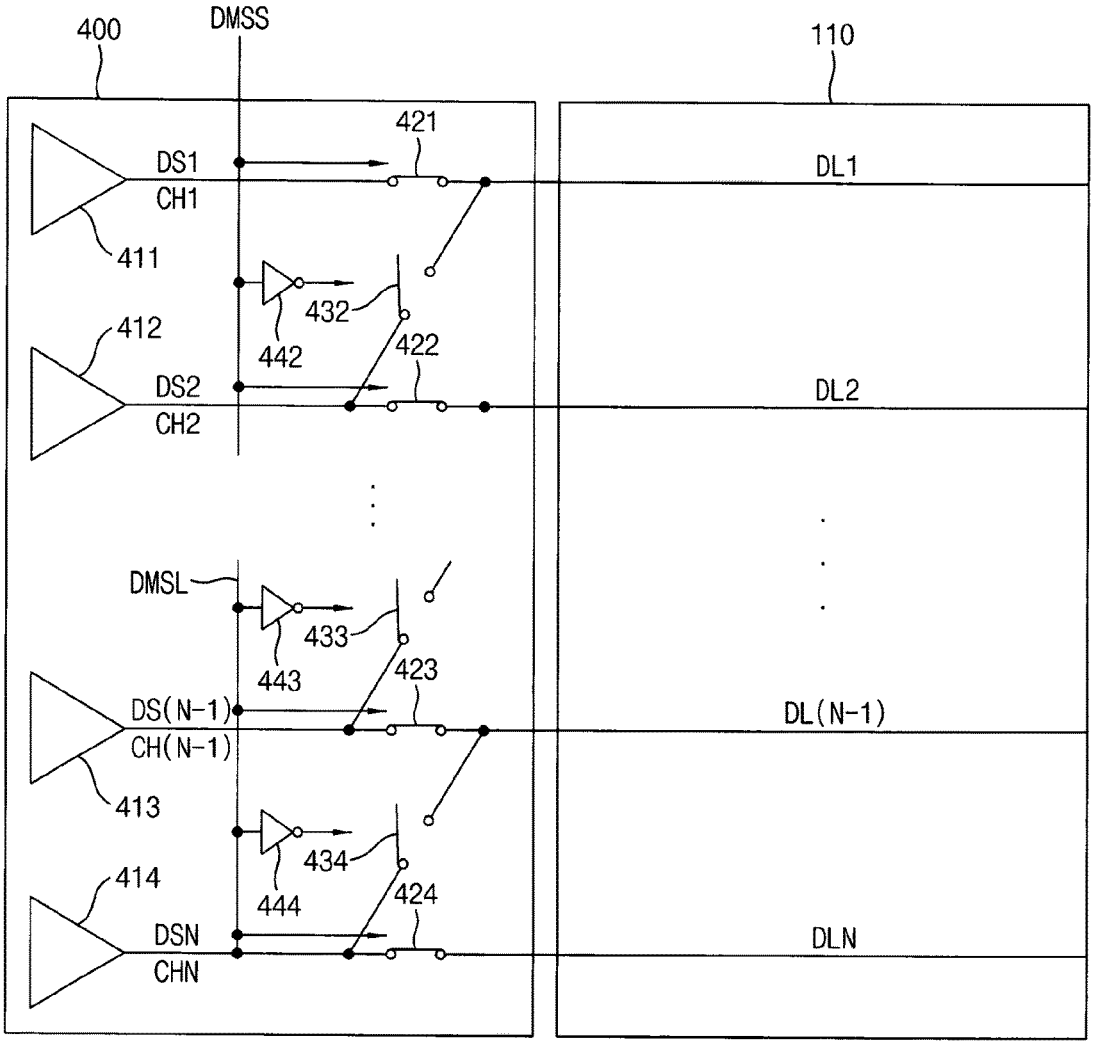
FIG. 8A is a block diagram illustrating a data driving integrated circuit and a display panel when a driving mode selection signal of FIG. 7 is at a first level.

FIG. 8A is a block diagram illustrating the data driving integrated circuit 400 and the display panel 110 when the driving mode selection signal DMSS of FIG. 7 is at the first level.

Referring to FIGS. 7 and 8A, when the driving mode selection signal DMSS is at the first level, each of the first to N-th normal driving switches 421, 422, 423 and 424 may be closed, and each of the second to N-th shift driving switches 432, 433 and 434 may be opened. Therefore, the data driving integrated circuit 400 may output the first to N-th data signals DS1, DS2, DS(N−1) and DSN to the first to N-th data lines DL1, DL2, DL(N−1) and DLN, respectively.

Figure 8B:
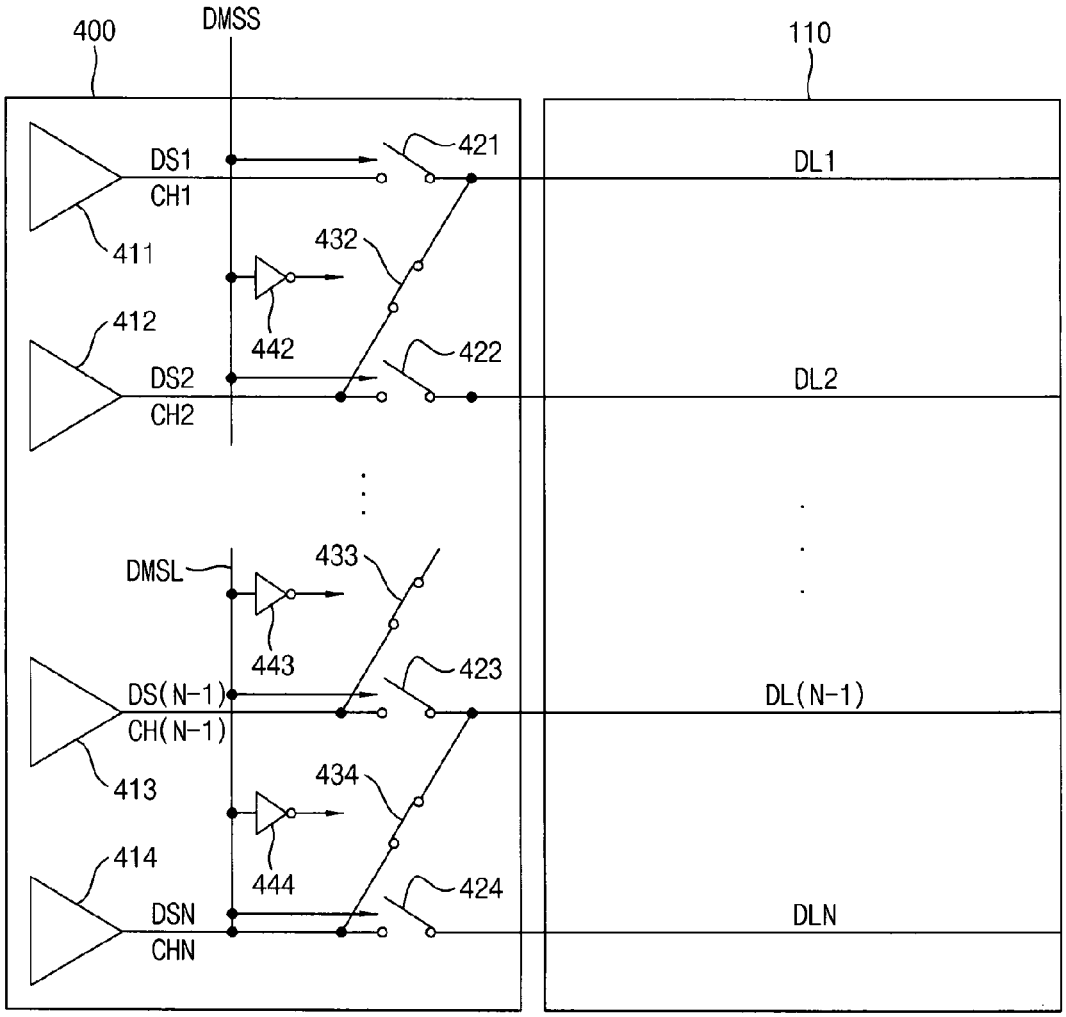
FIG. 8B is a block diagram illustrating the data driving integrated circuit and the display panel when the driving mode selection signal of FIG. 7 is at a second level.

FIG. 8B is a block diagram illustrating the data driving integrated circuit 400 and the display panel 110 when the driving mode selection signal DMSS of FIG. 7 is the second level.

Referring to FIGS. 7 and 8B, when the driving mode selection signal DMSS is the second level, each of the first to N-th normal driving switches 421, 422, 423 and 424 may be opened, and each of the second to N-th shift driving switches 432, 433 and 434 may be closed. Therefore, the data driving integrated circuit 400 shifts the N-th to second data signals DSN, DS(N−1) and DS2 by one channel in the direction opposite to the direction in which the first to N-th data lines DL1, DL2, DL(N−1) and DLN are sequentially arranged to output the N-th to second data signals DSN, DS(N−1) and DS2. For example, the data driving integrated circuit 400 outputs an N-th data signal DSN to an (N−1)-th data line DL(N−1). In addition, the data driving integrated circuit 400 outputs an (N−1)-th data signal DSN to an (N−2)-th data line. Similarly, the data driving integrated circuit 400 outputs a second data signal DS2 to a first data line DL1. In this case, a dummy data signal may be applied to an N-th data line DLN.

Figure 9A:
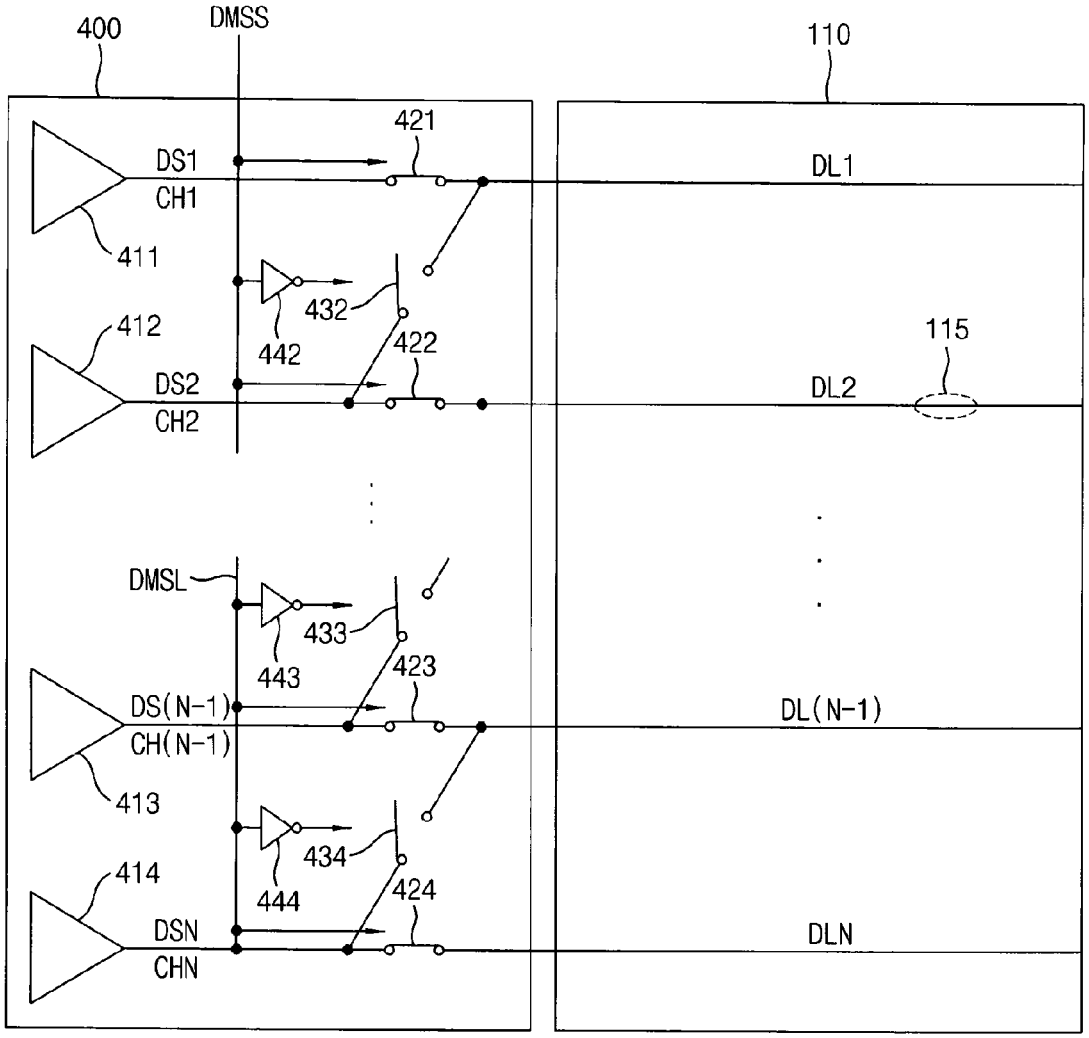
FIG. 9A is a block diagram illustrating the data driving integrated circuit and the display panel of FIG. 7 when fault is generated in the display panel and the data driving integrated circuit performs normal driving.

FIG. 9A is a block diagram illustrating the data driving integrated circuit 400 and the display panel 110 of FIG. 7 when a fault is generated in the display panel 110 and the data driving integrated circuit 400 performs normal driving.

Referring to FIGS. 7 to 9, according to an exemplary embodiment of the present inventive concept, the fault may be generated in the second data line DL2 of the display panel 110. In this case, when the data driving integrated circuit 400 performs normal driving in which the data driving integrated circuit 400 outputs the first to N-th data signals DS1, DS2, DS(N−1) and DSN to the first to N-th data lines DL1, DL2, DL(N−1) and DLN, respectively, a defect 115 may be displayed on the second data line DL2 of the display panel 110.

Figure 9B:
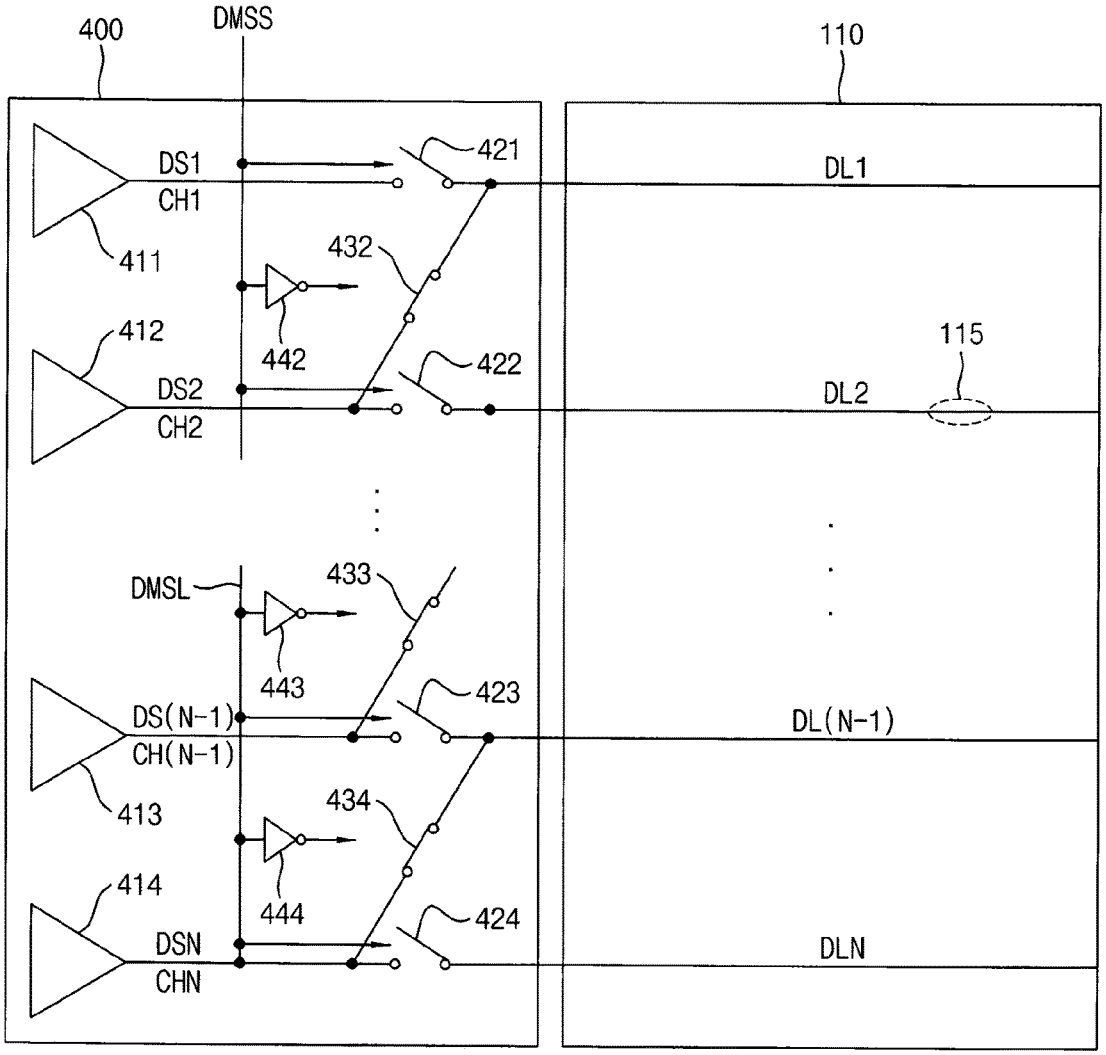
FIG. 9B is a block diagram illustrating the data driving integrated circuit and the display panel of FIG. 7 when the fault is generated in the display panel and the data driving integrated circuit performs shift driving.

FIG. 9B is a block diagram illustrating the data driving integrated circuit 400 and the display panel 110 of FIG. 7 when the fault is generated in the display panel 110 and the data driving integrated circuit 400 performs shift driving.

Referring to FIGS. 7, 8 and 9B, according to exemplary embodiments of the present invention, the fault may be generated in the second data line DL2 of the display panel 110. When the data driving integrated circuit 400 performs shift driving in which the data driving integrated circuit 400 shifts the N-th to second data signals DSN, DS(N−1) and DS2 by one channel and outputs the N-th to second data signals DSN, DS(N−1) and DSN, since the fault is generated in the second data line DL2, the defect 115 may be displayed on the second data line DL2 of the display panel 110.

As described above, when the fault is generated in the display panel 110, a position of the defect 115 in the image displayed on the display panel 110 does not change when the data driving integrated circuit 400 switches between normal driving and shift driving.

Figure 9C:
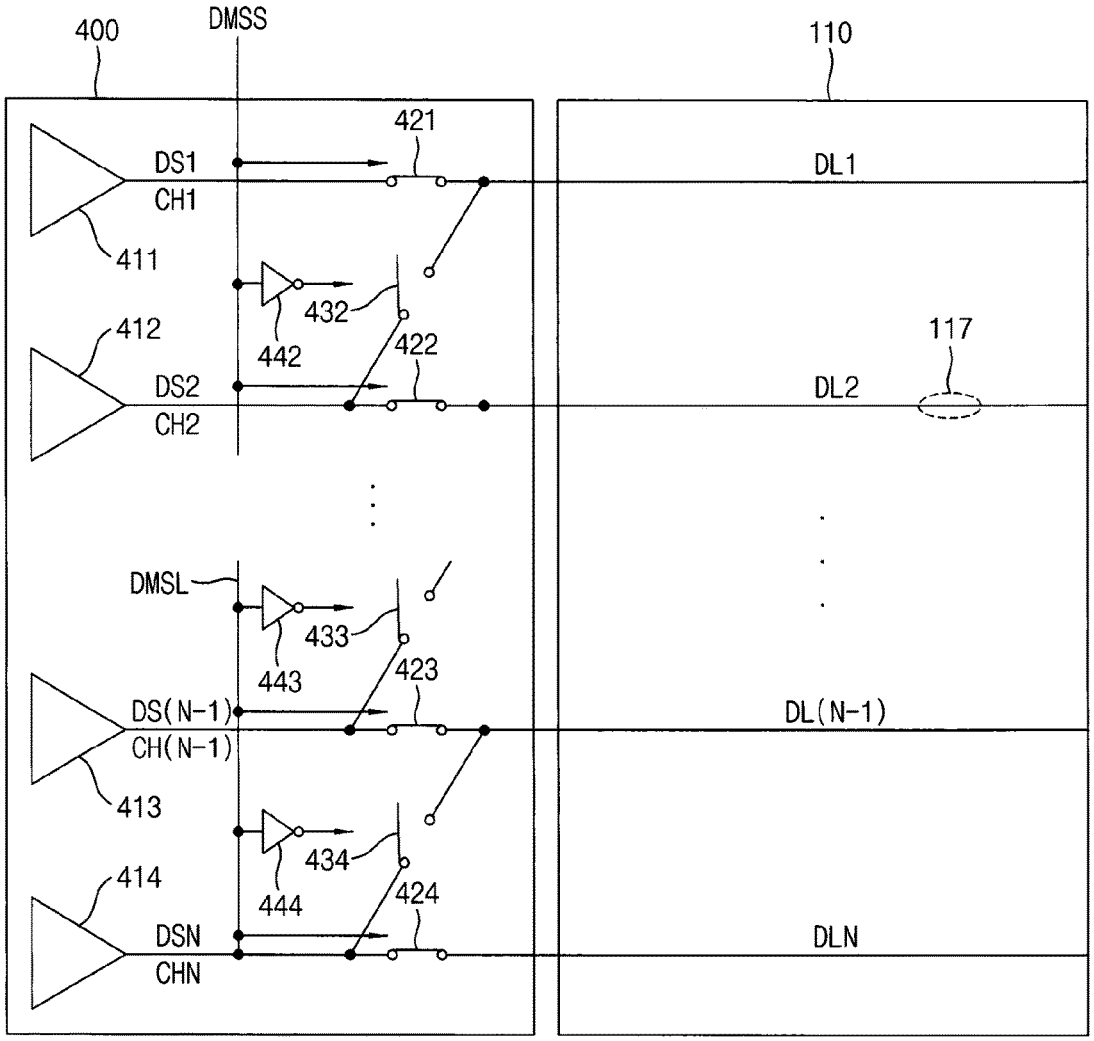
FIG. 9C is a block diagram illustrating the data driving integrated circuit and the display panel of FIG. 7 when fault is generated in the data driving integrated circuit and the data driving integrated circuit performs normal driving.

FIG. 9C is a block diagram illustrating the data driving integrated circuit 400 and the display panel 110 of FIG. 7 when a fault is generated in the data driving integrated circuit 400 and the data driving integrated circuit 400 performs normal driving.

Referring to FIGS. 7, 8 and 9C, according to exemplary embodiments of the present invention, a fault may be generated in a second buffer 412 in the data driving integrated circuit 400. In this case, when the data driving integrated circuit 400 performs normal driving in which the data driving integrated circuit 400 outputs the first to N-th data signals DS1, DS2, DS(N−1) and DSN to the first to N-th data lines DL1, DL2, DL(N−1) and DLN, respectively, a defect 117 may be displayed on the second data line DL2 of the display panel 110.

Figure 9D:
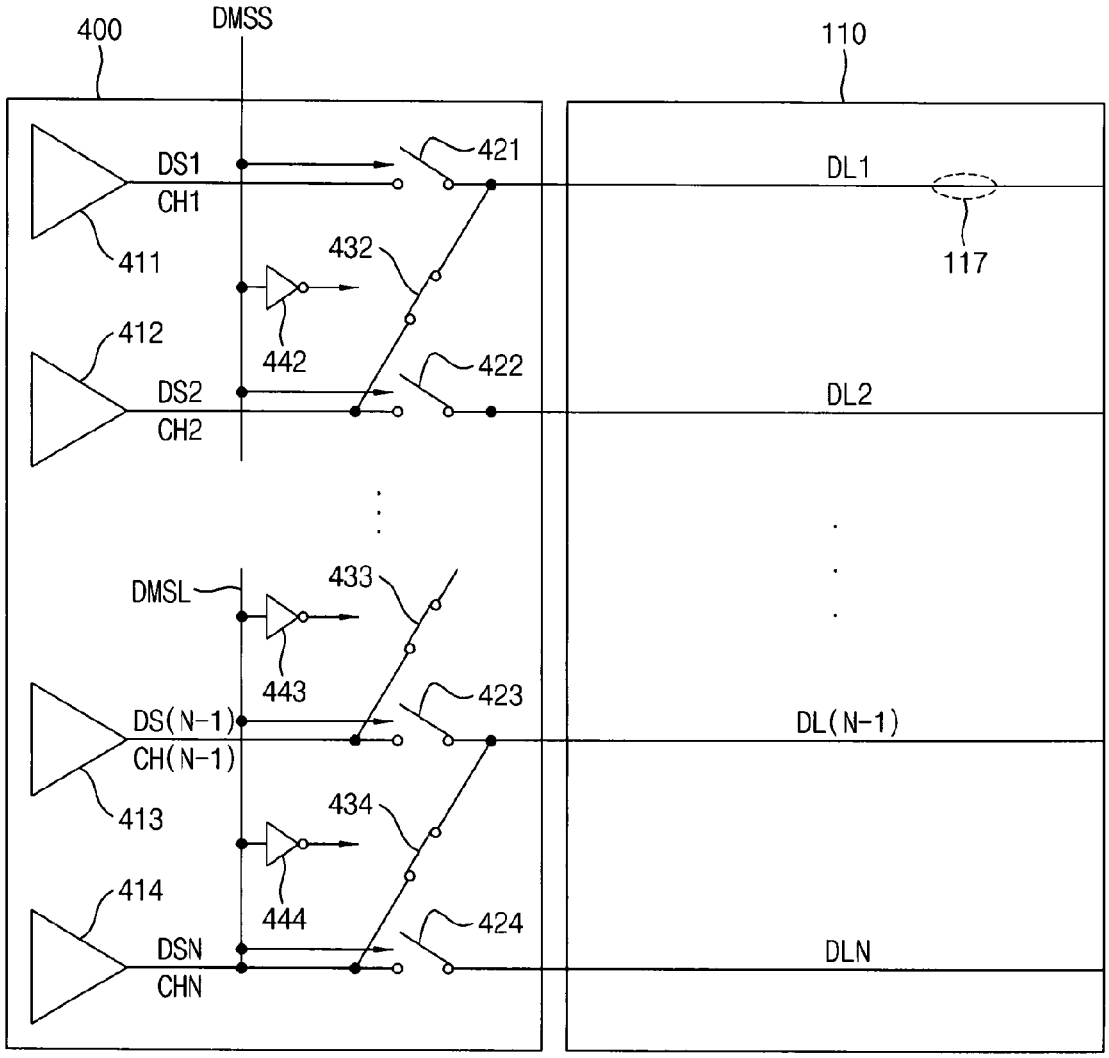
FIG. 9D is a block diagram illustrating the data driving integrated circuit and the display panel of FIG. 7 when the fault is generated in the data driving integrated circuit and the data driving integrated circuit performs shift driving.

FIG. 9D is a block diagram illustrating the data driving integrated circuit 400 and the display panel 110 of FIG. 7 when the fault is generated in the data driving integrated circuit 400 and the data driving integrated circuit 400 performs shift driving.

Referring to FIGS. 7, 8 and 9D, according to exemplary embodiments of the present invention, the fault may be generated in a second buffer 412 in the data driving integrated circuit 400. In this case, the data driving integrated circuit 400 performs shift driving in which the data driving integrated circuit 400 shifts the N-th to second data signals DSN, DS(N−1) and DS2 by one channel and outputs the N-th to second data signals DSN, DS(N−1) and DS2, since the defect is generated in the second buffer 412, the defect 117 may be displayed on the first data line DL1 of the display panel 110.

As described above, when the fault is generated in the data driving integrated circuit 400, a position of the defect 117 in the image displayed on the display panel 110 changes when the data driving integrated circuit 400 switches between normal driving and shift driving.

Thus, in a test process of the display apparatus 100 of FIG. 1, when the display panel 110 displays the defect, it may be easily and quickly determined whether the defect is caused by the fault of the display panel 110 or the defect is caused by the fault of the data driving part 200 of FIG. 1. The data driving integrated circuit 400 need not be separated from the data driving part 200 of FIG. 1 in order to make this determination.

Figure 10:
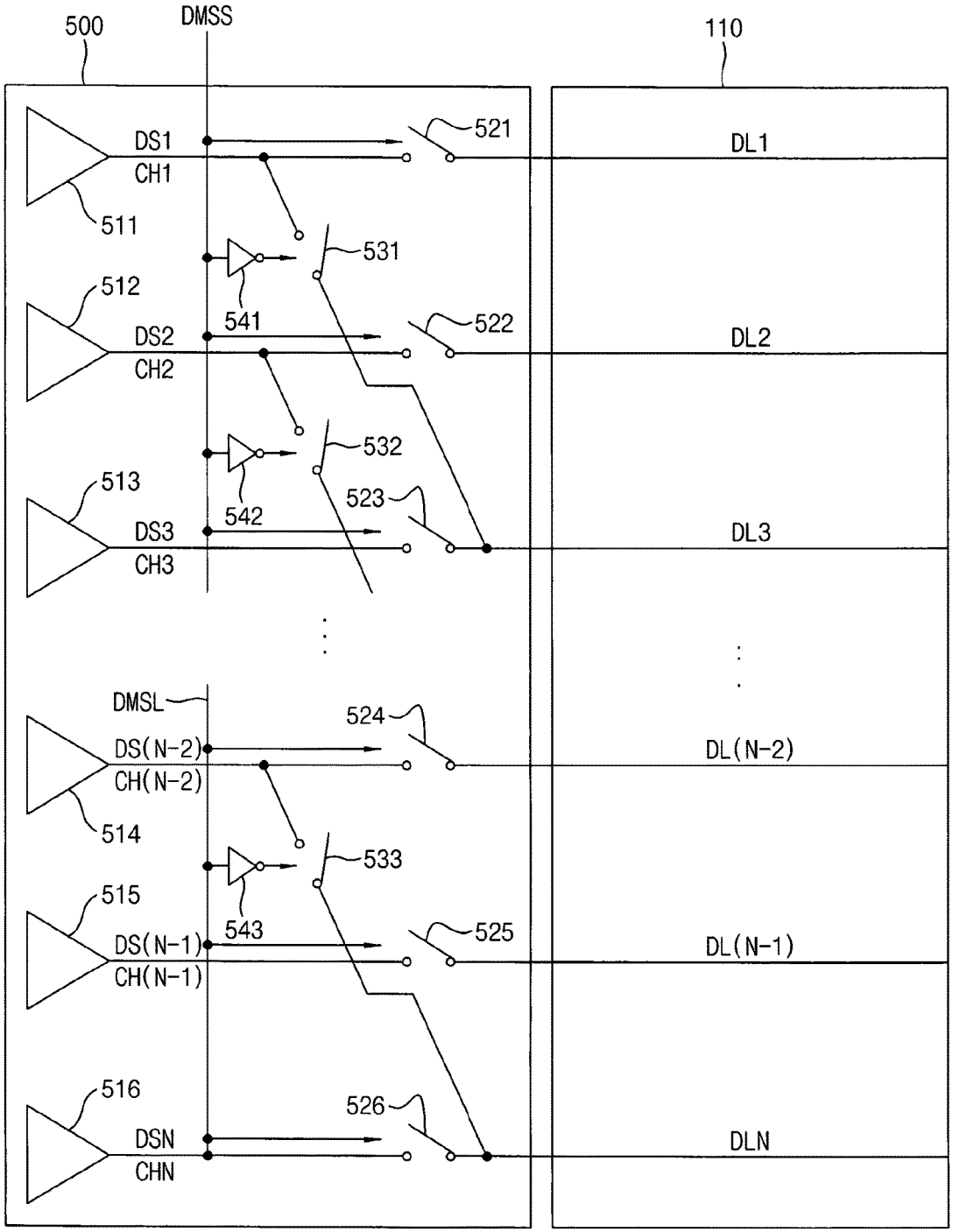
FIG. 10 is a block diagram illustrating a data driving integrated circuit and a display panel according to an exemplary embodiment of the present inventive concept.

FIG. 10 is a block diagram illustrating a data driving integrated circuit and a display panel according to an exemplary embodiment of the present inventive concept.

According to exemplary embodiments of the present invention, the data driving integrated circuit 500 illustrated in FIG. 10 may be included in the data driving part 200 illustrated in FIG. 1. In addition, the display panel 110 illustrated in FIG. 10 may be substantially the same as the display panel 110 illustrated in FIGS. 1 and 3. Thus, the same reference numerals may be used to refer to same or like parts as those described in the previous exemplary embodiment and any elements not described with respect to FIG. 10 may be assumed to be substantially similar to corresponding elements that have been previously described.

Referring to FIG. 10, the data driving integrated circuit 500 includes first to N-th buffers 511, 512, 513, 514, 515 and 516, first to N-th normal driving switches 521, 522, 523, 524, 525 and 526, first to (N−2)-th shift driving switches 531, 532 and 533, first to (N−2)-th inverters 541, 542 and 543, and a driving mode selection line DMSL.

The first to N-th buffers 511, 512, 513, 514, 515 and 516 output first to N-th data signals DS1, DS2, DS3, DS(N−2), DS(N−1) and DSN through first to N-th channels CH1, CH2, CH3, CH(N−2), CH(N−1) and CHN, respectively. The first to N-th channels CH1, CH2, CH3, CH(N−2), CH(N−1) and CHN may be connected to first to N-th data lines DL1, DL2, DL3, DL(N−2), DL(N−1) and DLN of the data lines DL of FIG. 1. The first to N-th data signals DS1, DS2, DS3, DS(N−2), DS(N−1) and DSN may be included in the data signals DS of FIG. 1.

The first to N-th normal driving switches 521, 522, 523, 524, 525 and 526 are disposed on the first to N-th channels CH1, CH2, CH3, CH(N−2), CH(N−1) and CHN, respectively. The first to N-th normal driving switches 521, 522, 523, 524, 525 and 526 connect or disconnect the first to N-th channels CH1, CH2, CH3, CH(N−2), CH(N−1) and CHN, respectively.

A first shift driving switch 531 is disposed between a first channel CH1 and a third channel CH3. The first shift driving switch 531 connects or disconnects between the first channel CH1 and the third channel CH3. A second shift driving switch 532 is disposed between the second channel CH2 and a fourth channel. The second shift driving switch 532 connects or disconnects between the second channel CH2 and the fourth channel. Similarly, an (N−2)-th shift driving switch 533 is disposed between an (N−2)-th channel CH(N−2) and an N-th channel CHN. The (N−2)-th shift driving switch 533 connects or disconnects between the (N−2)-th channel CH(N−2) and the N-th channel CHN.

The driving mode selection signal DMSS is transferred to the driving mode selection line DMSL. The driving mode selection signal DMSS is applied to each of the first to N-th normal driving switches 521, 522, 523, 524, 525 and 526.

The first to (N−2)-th inverters 541, 542 and 543 are disposed between the driving mode selection line DMSL and the first to (N−2)-th shift driving switches 531, 532 and 533. For example, a first inverter 541 is disposed between the driving mode selection line DMSL and the first shift driving switch 531. A second inverter 542 is disposed between the driving mode selection line DMSL and the second shift driving switch 532. An (N−2)-th inverter 543 is disposed between the driving mode selection line DMSL and the (N−2)-th shift driving switch 533.

For example, when the driving mode selection signal DMSS is at a first level, each of the first to N-th normal driving switches 521, 522, 523, 524, 525 and 526 may be closed, and each of the first to (N−2)-th shift driving switches 531, 532 and 533 may be opened. In addition, when the driving mode selection signal DMSS is at a second level that different from the first level, each of the first to N-th normal driving switches 521, 522, 523, 524, 525 and 526 may be opened, and each of the first to (N−2)-th shift driving switches 531, 532 and 533 may be closed. For example, the first level may be a low level, and the second level may be a high level.

The data driving integrated circuit 500 performs normal driving in which the data driving part 500 outputs the first to N-th data signals DS1, DS2, DS3, DS(N−2), DS(N−1) and DSN to the first to N-th data lines DL1, DL2, DL3, DL(N−2), DL(N−1) and DLN, respectively, according to the first level of the driving mode selection signal DMSS. In addition, the data driving integrated circuit 500 performs shift driving in which the data driving part 500 shifts first to (N−2)-th data signals DS1, DS2, DS3 and DS(N−2) among the first to N-th data signals DS1, DS2, DS3, DS(N−2), DS(N−1) and DSN by two channels to output the first to (N−2)-th data signals DS1, DS2, DS3 and DS(N−2), according to the second level of the driving mode selection signal DMSS. In this case, the data driving integrated circuit 500 may shift the first to (N−2)-th data signals DS1, DS2, DS3 and DS(N−2) by two channels in a direction in which the first to N-th data lines DL1, DL2, DL3, DL(N−2), DL(N−1) and DLN are sequentially arranged.

Figure 11A:
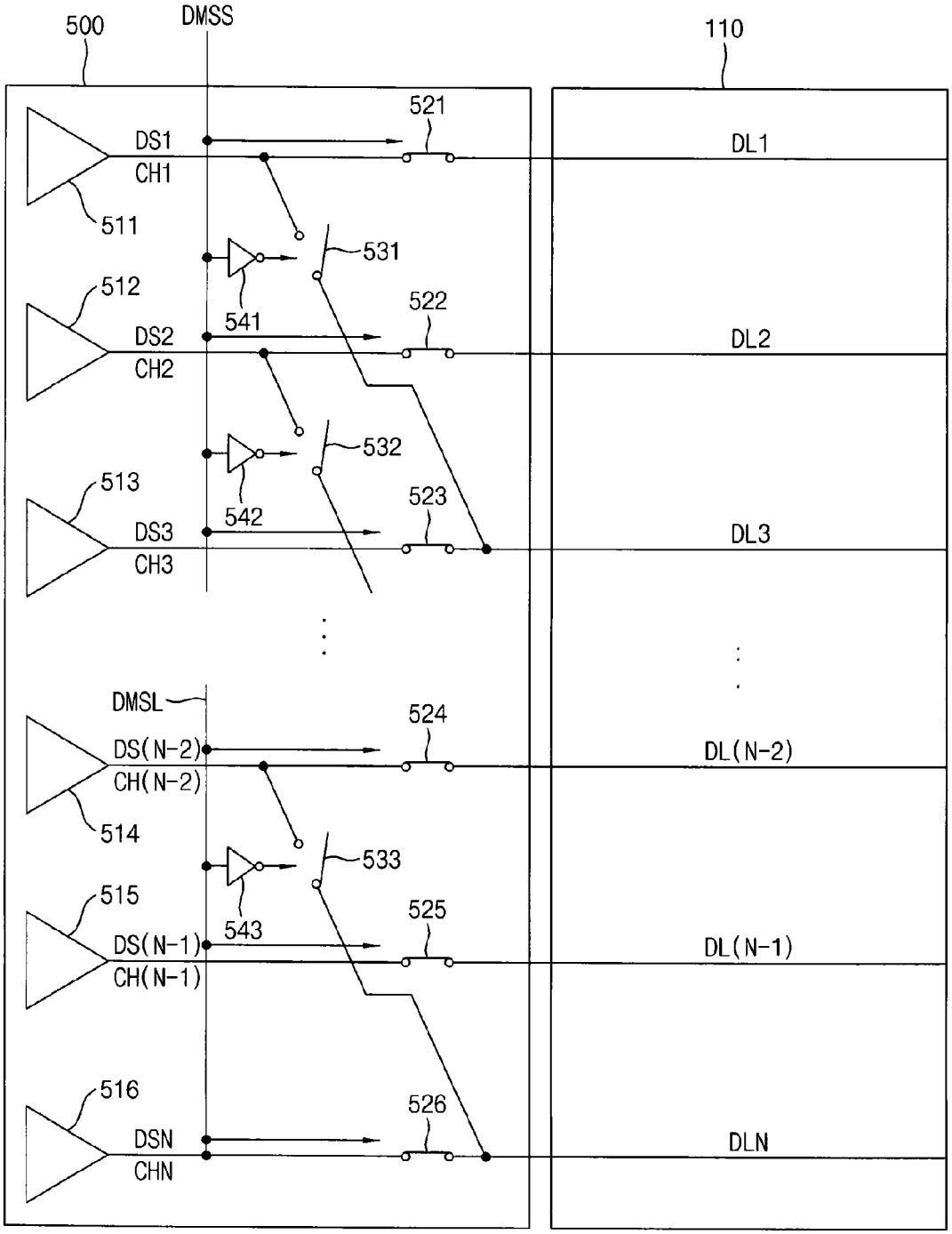
FIG. 11A is a block diagram illustrating a data driving integrated circuit and a display panel when a driving mode selection signal of FIG. 10 is at a first level.

FIG. 11A is a block diagram illustrating the data driving integrated circuit 500 and the display panel 110 when the driving mode selection signal DMSS of FIG. 10 is at the first level.

Referring to FIGS. 10 and 11A, when the driving mode selection signal DMSS is at the first level, each of the first to N-th normal driving switches 521, 522, 523, 524, 525 and 526 may be closed, and each of the first to (N−2)-th shift driving switches 531, 532 and 533 may be opened. Therefore, the data driving integrated circuit 500 may output the first to N-th data signals DS1, DS2, DS3, DS(N−2), DS(N−1) and DSN to the first to N-th data lines DL1, DL2, DL3, DL(N−2), DL(N−1) and DLN, respectively.

Figure 11B:
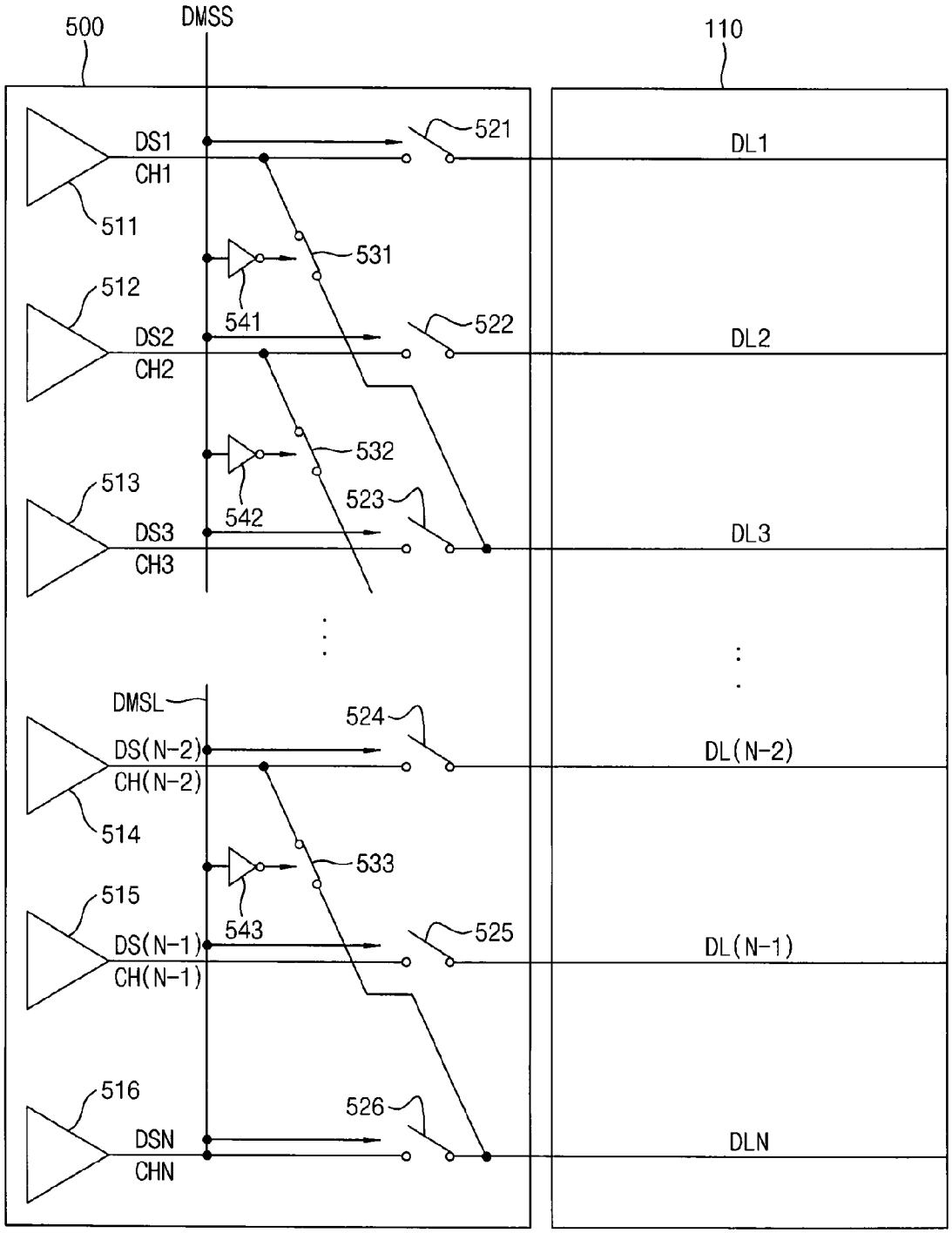
FIG. 11B is a block diagram illustrating the data driving integrated circuit and the display panel when the driving mode selection signal of FIG. 10 is at a second level.

FIG. 11B is a block diagram illustrating the data driving integrated circuit 500 and the display panel 110 when the driving mode selection signal DMSS of FIG. 10 is at the second level.

Referring to FIGS. 10 and 11B, when the driving mode selection signal DMSS is the second level, each of the first to N-th normal driving switches 521, 522, 523, 524, 525 and 526 may be opened, and each of the first to (N−2)-th shift driving switches 531, 532 and 533 may be closed. Therefore, the data driving integrated circuit 500 shifts the first to (N−2)-th data signals DS1, DS2, DS3 and DS(N−2) by two channels in the direction in which the first to N-th data lines DL1, DL2, DL3, DL(N−2), DL(N−1) and DLN are sequentially arranged and outputs the first to (N−2)-th data signals DS1, DS2, DS3 and DS(N−2). For example, the data driving integrated circuit 500 outputs a first data signal DS1 to a third data line DL3. In addition, the data driving integrated circuit 500 outputs a second data signal DS2 to a fourth data line. Similarly, the data driving integrated circuit 500 outputs an (N−2)-th data signal DS(N−2) to an N-th data line DL. In this case, a dummy data signal may be applied to each of a first data line DL1 and a second data line DL2.

Figure 12A:
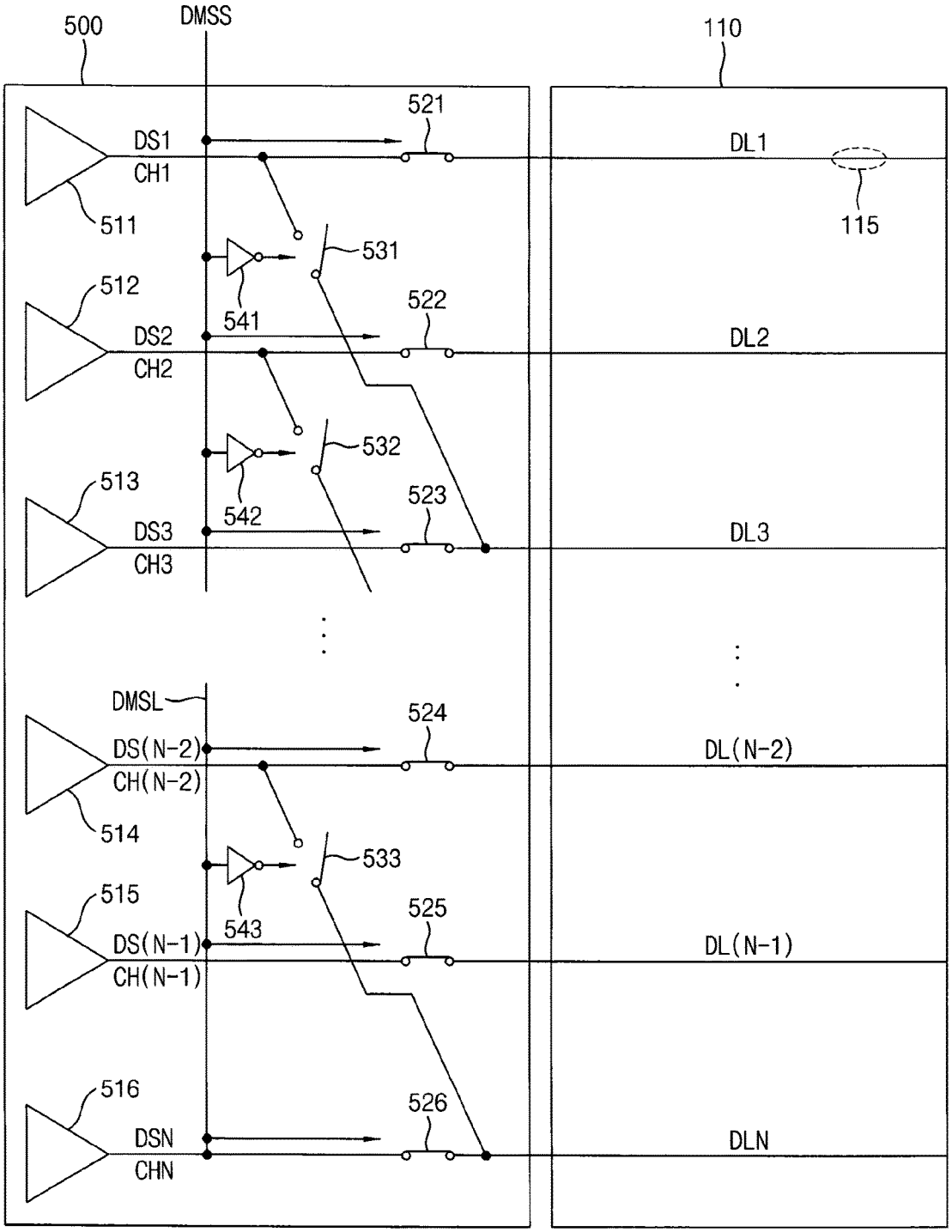
FIG. 12A is a block diagram illustrating the data driving integrated circuit and the display panel of FIG. 10 when the fault is generated in the display panel and the data driving integrated circuit performs normal driving.

FIG. 12A is a block diagram illustrating the data driving integrated circuit 500 and the display panel 110 of FIG. 10 when a fault is generated in the display panel 110 and the data driving integrated circuit 500 performs normal driving.

Referring to FIGS. 10 to 12A, according to exemplary embodiments of the present invention, the fault may be generated in the first data line DL1 of the display panel 110. In this case, when the data driving integrated circuit 500 performs normal driving in which the data driving integrated circuit 500 outputs the first to N-th data signals DS1, DS2, DS3, DS(N−2), DS(N−1) and DSN to the first to N-th data lines DL1, DL2, DL3, DL(N−2), DL(N−1) and DLN, respectively, defect 115 may be displayed on the first data line DL1 of the display panel 110.

Figure 12B:
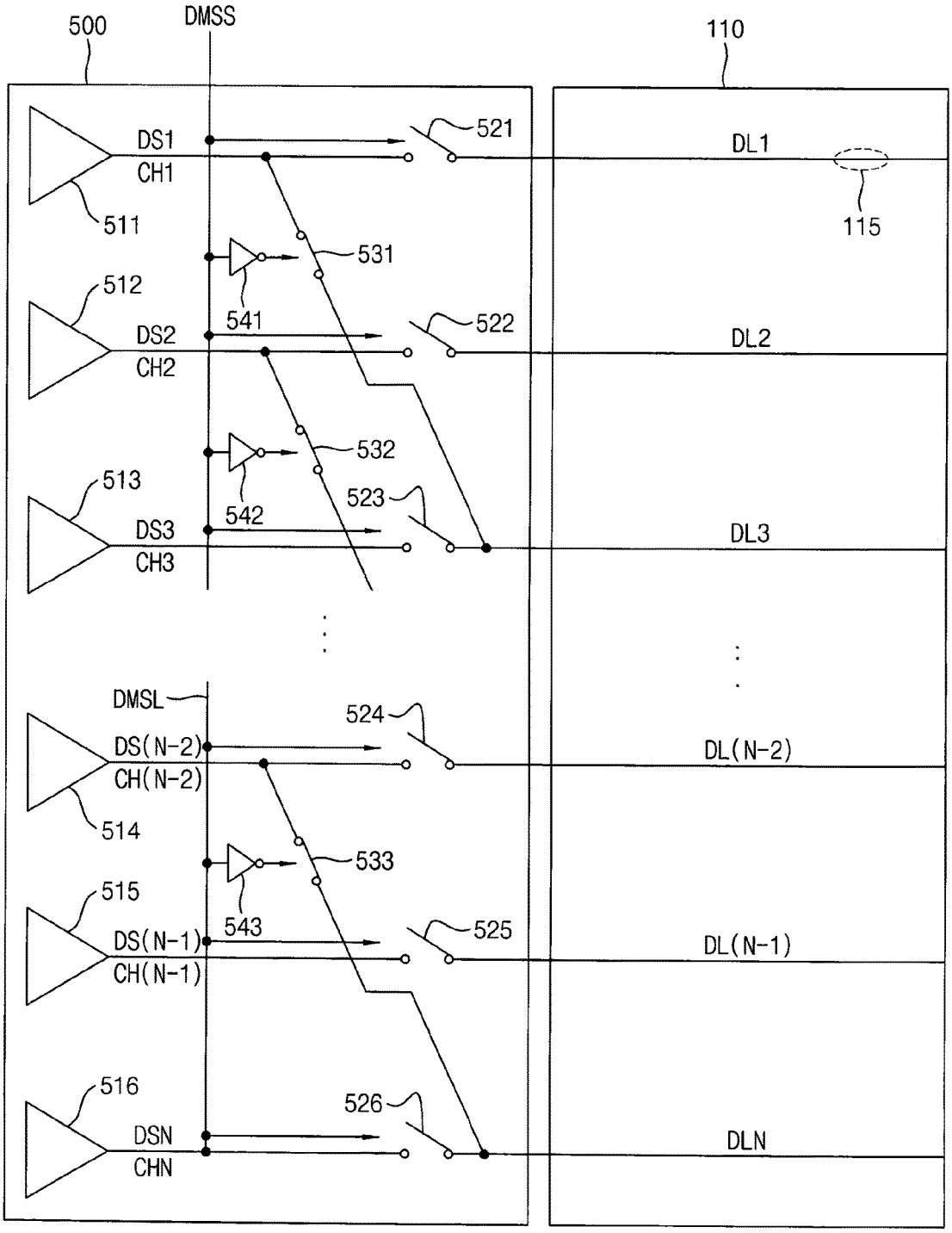
FIG. 12B is a block diagram illustrating the data driving integrated circuit and the display panel of FIG. 10 when the fault is generated in the display panel and the data driving integrated circuit performs shift driving.

FIG. 12B is a block diagram illustrating the data driving integrated circuit 500 and the display panel 110 of FIG. 10 when the fault is generated in the display panel 110 and the data driving integrated circuit 500 performs shift driving.

Referring to FIGS. 10, 11 and 12B, according to exemplary embodiments of the present invention, the fault may be generated in the first data line DL1 of the display panel 110. In this case, when the data driving integrated circuit 500 performs shift driving in which the data driving integrated circuit 500 shifts the first to (N−2)-th data signals DS1, DS2, DS3 and DS(N−2) by two channels and outputs the first to (N−2)-th data signals DS1, DS2, DS3 and DS(N−2), since the fault is generated in the first data line DL1, the defect 115 may be displayed on the first data line DL1 of the display panel 110.

As described above, when the fault is generated in the display panel 110, a position of the defect 115 in the image displayed on the display panel 110 does not move when the data driving integrated circuit 500 switches between normal driving and shift driving.

Figure 12C:
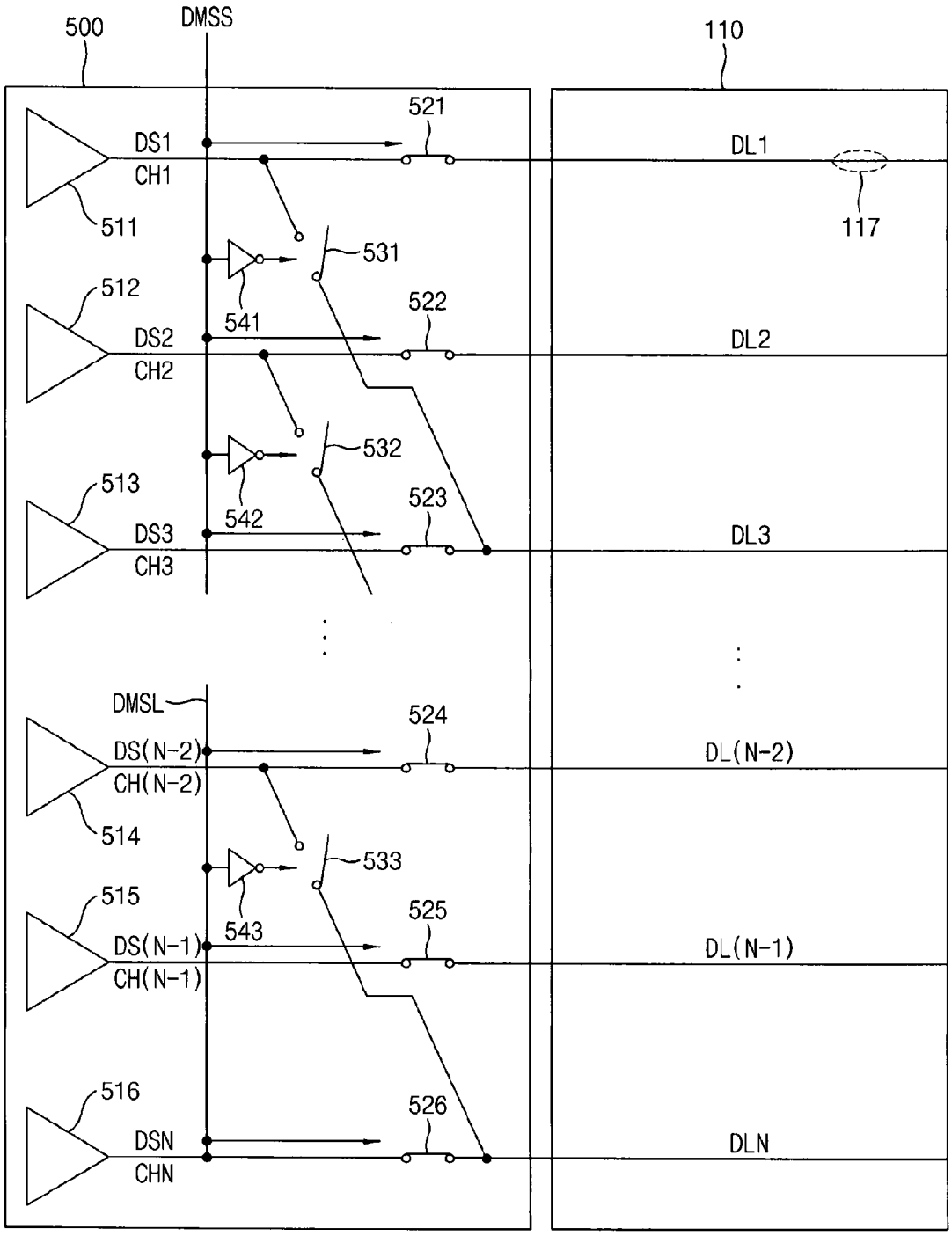
FIG. 12C is a block diagram illustrating the data driving integrated circuit and the display panel of FIG. 10 when the fault is generated in the data driving integrated circuit and the data driving integrated circuit performs normal driving.

FIG. 12C is a block diagram illustrating the data driving integrated circuit 500 and the display panel 110 of FIG. 10 when the fault is generated in the data driving integrated circuit 500 and the data driving integrated circuit 500 performs normal driving.

Referring to FIGS. 10, 11 and 12C, according to exemplary embodiments of the present invention, fault may be generated in a first buffer 511 in the data driving integrated circuit 500. In this case, when the data driving integrated circuit 500 performs normal driving in which the data driving integrated circuit 500 outputs the first to N-th data signals DS1, DS2, DS3, DS(N−2), DS(N−1) and DSN to the first to N-th data lines DL1, DL2, DL3, DL(N−2), DL(N−1) and DLN, respectively, the defect 117 may be displayed on the first data line DL1 of the display panel 110.

Figure 12D:
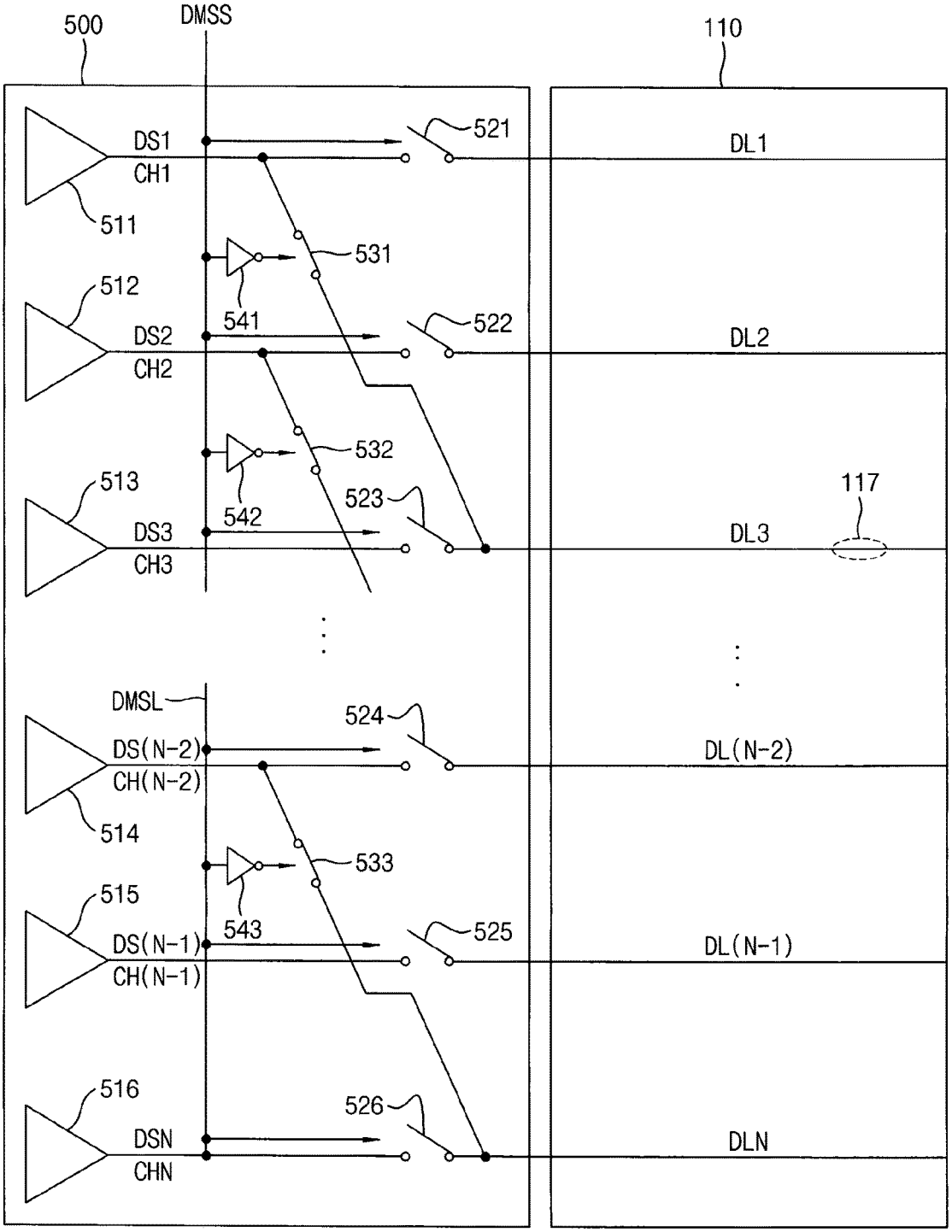
FIG. 12D is a block diagram illustrating the data driving integrated circuit and the display panel of FIG. 10 when the fault is generated in the data driving integrated circuit and the data driving integrated circuit performs shift driving.

FIG. 12D is a block diagram illustrating the data driving integrated circuit 500 and the display panel 110 of FIG. 10 when the fault is generated in the data driving integrated circuit 500 and the data driving integrated circuit 500 performs shift driving.

Referring to FIGS. 10, 11 and 12D, according to exemplary embodiments of the present invention, the fault may be generated in the first buffer 511 in the data driving integrated circuit 500. In this case, when the data driving integrated circuit 500 performs shift driving in which the data driving integrated circuit 500 shifts the first to (N−2)-th data signals DS1, DS2, DS3 and DS(N−2) by two channels and outputs the first to (N−2)-th data signals DS1, DS2, DS3 and DS(N−2), since the fault is generated in the first buffer 511, the defect 117 may be displayed on the third data line DL3 of the display panel 110.

As described above, when the fault is generated in the data driving integrated circuit 500, a position of the defect 117 in the image displayed on the display panel 110 changes location when the data driving integrated circuit 500 switches between normal driving and shift driving.

Thus, in the test process of the display apparatus 100, when the display panel 110 displays the defect, it may be easily and quickly determined whether the defect is caused by the fault of the display panel 110 or the defect is caused by the fault of the data driving part 200. The data driving integrated circuit 500 does not need to be separated from the data driving part 200 to make this determination.

Figure 13:
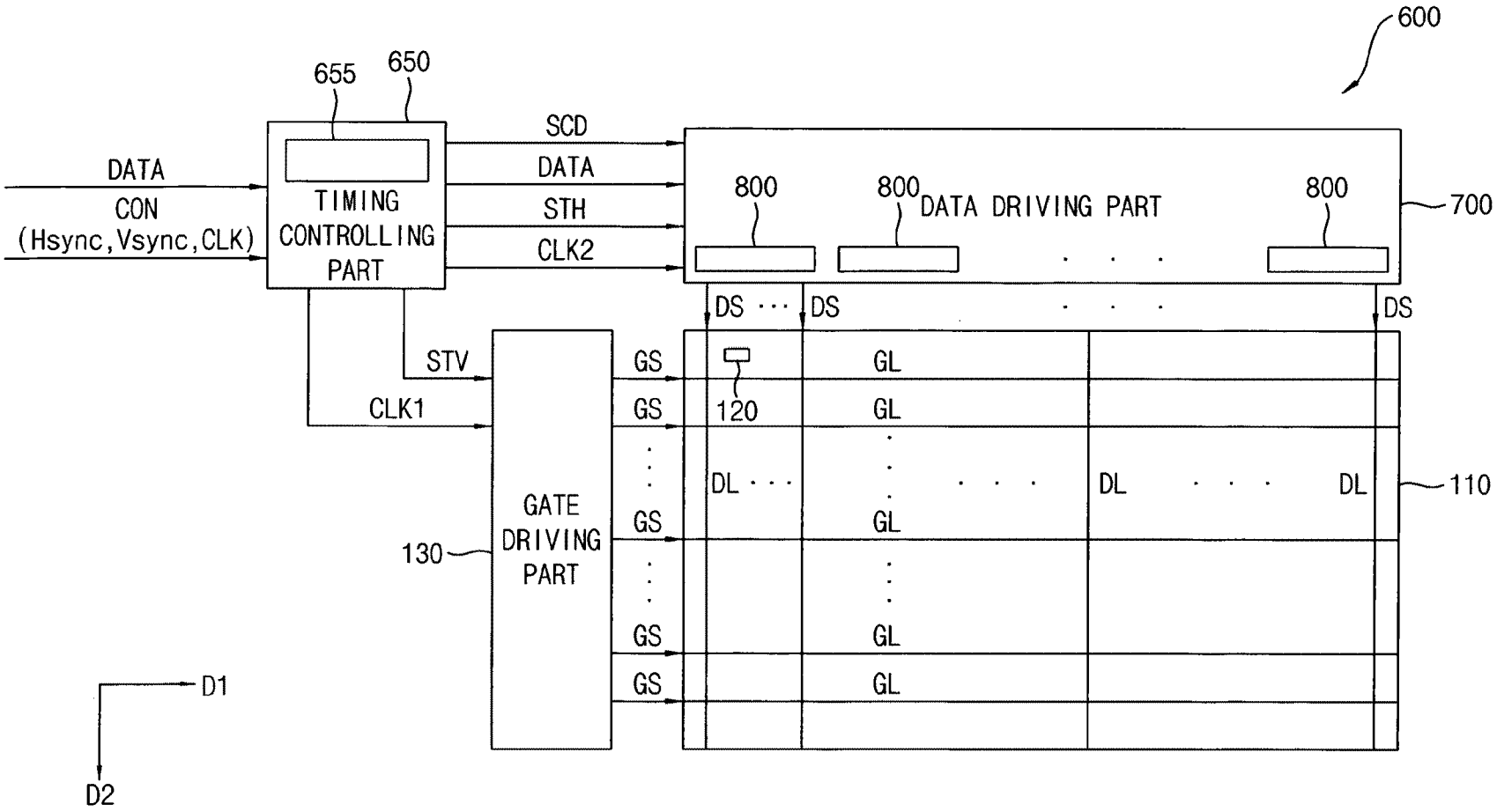
FIG. 13 is a block diagram illustrating a display apparatus according to an exemplary embodiment of the present inventive concept.

FIG. 13 is a block diagram illustrating a display apparatus according to an exemplary embodiment of the present inventive concept.

The display apparatus 600 illustrated in FIG. 13 may be substantially the same as the display apparatus 100 illustrated in FIG. 1 except for a timing controlling part 650 and a data driving part 700 thereof. Thus, the same reference numerals may be used to refer to same or like parts as those described above and to the extent that detailed disclosure is not presented for certain elements, it may be understood that these elements are substantially similar to corresponding elements that have been described in detail above.

Referring to FIG. 13, the display apparatus 600 according to exemplary embodiments of the present invention includes the display panel 110, the gate driving part 130, the data driving part 700 and the timing controlling part 650.

The display panel 110 receives the data signal DS from the data driving part 700 to display an image.

The gate driving part 130 generates the gate signals GS in response to the vertical start signal STV and the first clock signal CLK1 provided from the timing controlling part 650, and outputs the gate signals GS to the gate lines GL.

The data driving part 700 receives the image data DATA from the timing controlling part 650, generates the data signal DS based on the image data DATA, and outputs the data signal DS to the data line DL in response to the horizontal start signal STH and the second clock signal CLK2 provided from the timing controlling part 650. The data driving part 700 may include a plurality of data driving integrated circuits 800 which output the data signals DS.

The timing controlling part 650 receives the image data DATA and the control signal CON from an outside source. The control signal CON may include the horizontal synchronous signal Hsync, the vertical synchronous signal Vsync and the clock signal CLK. The timing controlling part 650 generates the horizontal start signal STH using the horizontal synchronous signal Hsync and outputs the horizontal start signal STH to the data driving part 700. In addition, the timing controlling part 650 generates the vertical start signal STV using the vertical synchronous signal Vsync and outputs the vertical start signal STV to the gate driving part 130. In addition, the timing controlling part 650 generates the first clock signal CLK1 and the second clock signal CLK2 using the clock signal CLK, outputs the first clock signal CLK1 to the gate driving part 130, and outputs the second clock signal CLK2 to the data driving part 700.

In addition, the timing controlling part 650 further outputs switch control data SCD to the data driving part 700. For example, the switch control data SCD may be packet data. The timing controlling part 650 may include a memory 655 storing the switch control data SCD. For example, the memory 655 may be an Electrically Erasable Programmable Read-Only Memory (EEPROM).

Figure 14:
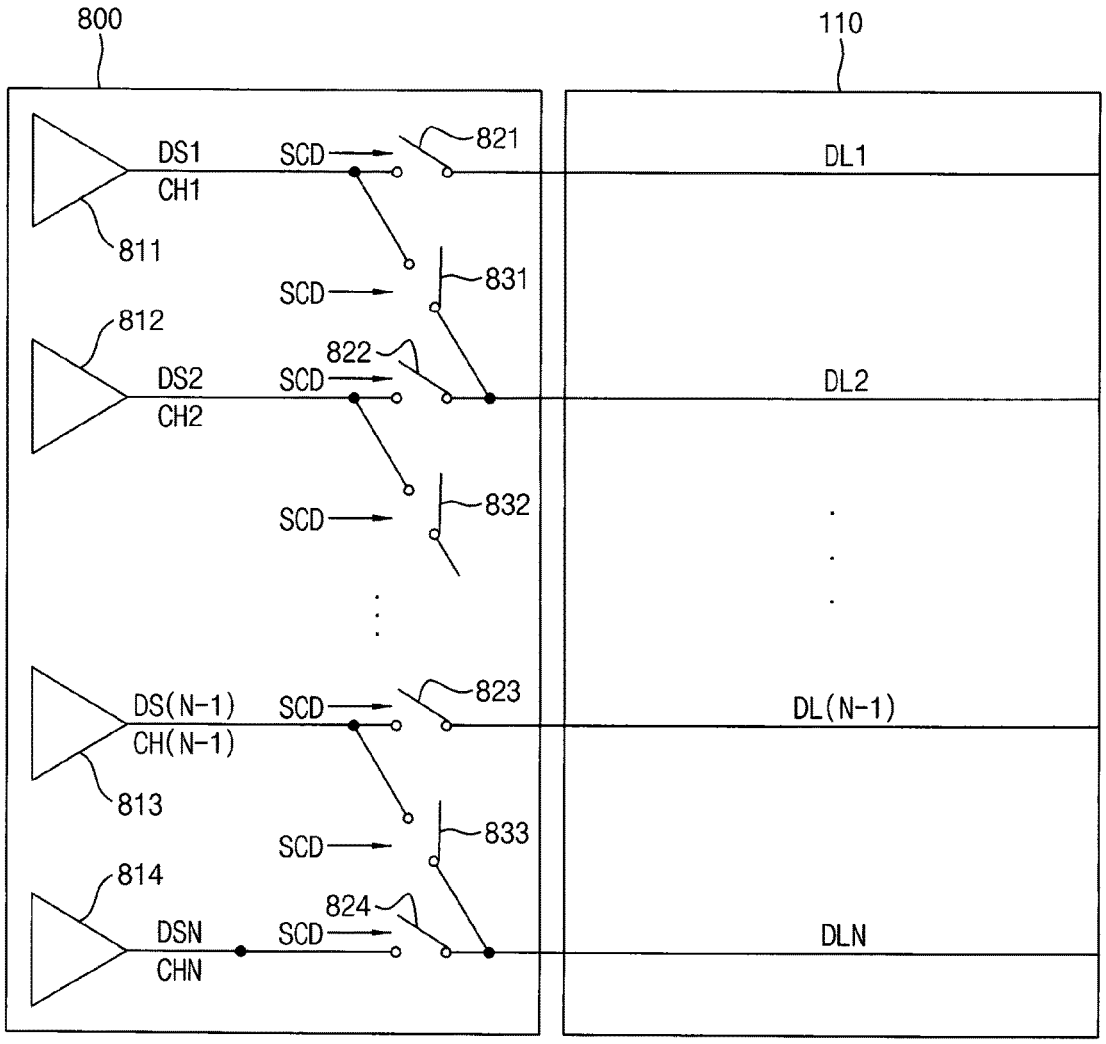
FIG. 14 is a block diagram illustrating a data driving integrated circuit and a display panel of FIG. 13.

FIG. 14 is a block diagram illustrating the data driving integrated circuit 800 and the display panel 110 of FIG. 13.

Referring to FIGS. 13 and 14, the data driving integrated circuit 800 includes first to N-th buffers 811, 812, 813 and 814, first to N-th normal driving switches 821, 822, 823 and 824, and first to (N−1)-th shift driving switches 831, 832 and 833.

The first to N-th buffers 811, 812, 813 and 814 output first to N-th data signals DS1, DS2, DS(N−1) and DSN through first to N-th channels CH1, CH2, CH(N−1) and CHN, respectively. The first to N-th channels CH1, CH2, CH(N−1) and CHN may be respectively connected to first to N-th data lines DL1, DL2, DL(N−1) and DLN of the data lines DL of FIG. 13. The first to N-th data signals DS1, DS2, DS(N−1) and DSN may be included in the data signals DS of FIG. 13.

The first to N-th normal driving switches 821, 822, 823 and 824 are disposed on the first to N-th channels CH1, CH2, CH(N−1) and CHN, respectively. The first to N-th normal driving switches 821, 822, 823 and 824 connect or disconnect the first to N-th channels CH1, CH2, CH(N−1) and CHN, respectively.

A first shift driving switch 831 is disposed between a first channel CH1 and a second channel CH2. The first shift driving switch 831 connects or disconnects between the first channel CH1 and the second channel CH2. A second shift driving switch 832 is disposed between the second channel CH2 and a third channel. The second shift driving switch 832 connects or disconnects between the second channel CH2 and the third channel. Similarly, an (N−1)-th shift driving switch 833 is disposed between an (N−1)-th channel and an N-th channel CHN. The (N−1)-th shift driving switch 833 connects or disconnects between the (N−1)-th channel and the N-th channel CHN.

Each of the first to N-th normal driving switches 821, 822, 823 and 824 and each of the first to (N−1)-th shift driving switches 831, 832 and 833 may be controlled by the switch control data SCD output from the timing controlling part 650.

For example, each of the first to N-th normal driving switches 821, 822, 823 and 824 may be closed, and each of the first to (N−1)-th shift driving switches 831, 832 and 833 may be opened, according to the switch control data SCD. In this case, the data driving integrated circuit 800 performs normal driving in which the data driving part 800 outputs the first to N-th data signals DS1, DS2, DS(N−1) and DSN to the first to N-th data lines DL1, DL2, DL(N−1) and DLN, respectively. In addition, each of the first to N-th normal driving switches 821, 822, 823 and 824 may be opened, and each of the first to (N−1)-th shift driving switches 831, 832 and 833 may be closed, according to the switch control data SCD. In this case, the data driving integrated circuit 800 performs shift driving in which the data driving part 800 shifts first to (N−1)-th data signals DS1, DS2 and DS(N−1) by one channel to output the first to (N−1)-th data signals DS1, DS2 and DS(N−1).

Accordingly, in a test process of the display apparatus 100, when the display panel 110 displays the defect, it may be easily and quickly determined whether the defect is caused by the fault of the display panel 110 or the defect is caused by the fault of the data driving part 700. Thus, the test process of the display apparatus 100 may be performed more efficiently.

The present inventive concept may be applied to an electronic device having a display apparatus. For example, the present inventive concept may be applied to a television, a computer monitor, a laptop computer, a digital camera, a cellular phone, a smart phone, a tablet computer, a Personal Computer (PC), a Personal Digital Assistant (PDA), a Portable Multimedia Player (PMP), an MP3 player, a navigation system, a camcorder, a portable game console, etc.

The foregoing exemplary embodiments are illustrative of the present inventive concept. Those skilled in the art will readily appreciate that many modifications are possible in the exemplary embodiments without materially departing from the novel teachings and aspects of the present inventive concept. Accordingly, all such modifications are intended to be included within the scope of the present inventive concept.

What is claimed is:

1. A display apparatus comprising:

a display panel configured to display an image, and the display panel including a plurality of gate lines and a plurality of data lines;

a gate driving part configured to output gate signals to the plurality of gate lines; and a data driving part comprising a plurality of channels configured to output data signals to the plurality of data lines, and the plurality of channels further configured to shift the data signals by M channel, where M is a positive integer, according to a driving mode selection signal for selecting a driving mode of the display panel, wherein in shifting the data signals by M channels, a connection between each data signal of the plurality of data signals to each original channel of the plurality of channels is changed so as to connect each data signal of the plurality of data signals to a different channel of the plurality of channels that is spaced apart from the original channel of the plurality of channels by the M channels, wherein the display apparatus further includes a plurality of normal driving switches, each of which is disposed along a corresponding data line of the plurality of data lines, and each of the plurality of normal driving switches being configured to maintain a connection between the corresponding data line and a corresponding original channel of the plurality of channels when the driving mode is a normal driving mode and to interrupt the connection between the corresponding data line and the corresponding original channel of the plurality of channels when the driving mode is a shift driving mode, and wherein the display apparatus further includes a plurality of shift driving switches each of which is disposed between a pair of corresponding data lines of the plurality of data lines, and each of the plurality of shift driving switches being configured to maintain a connection between the pair of corresponding data lines when the driving mode is the shift driving mode and to interrupt the connection between the pair of corresponding data lines when the driving mode is the normal driving mode.

2. The display apparatus of claim 1, wherein the data driving part outputs the data signals to the plurality of data lines, respectively, when the driving mode selection signal is at a first level.

3. The display apparatus of claim 2, wherein the data driving part shifts the data signals by M channel when the driving mode selection signal is at a second level that is different from the first level.

4. A display apparatus comprising:

a display panel configured to display an image, and the display panel including a plurality of gate lines and a plurality of data lines;

a gate driving part configured to output gate signals to the plurality of gate lines; and a data driving part comprising a plurality of channels configured to output data signals to the plurality of data lines, and the plurality of channels further configured to shift the data signals by M channel, where M is a positive integer, according to a driving mode selection signal for selecting a driving mode of the display panel, wherein the data driving part comprises first to N-th channels, wherein N is an integer greater than M, and the data driving part is configured to output first to N-th data signals of the data signals, and the data driving part is further configured to output the first to N-th data signals to first to N-th data lines of the plurality of data lines when the driving mode selection signal is at a first level.

5. The display apparatus of claim 4, wherein the data driving part outputs first to (N−1)-th data signals to second to N-th data lines of the data lines, respectively, when the driving mode selection signal is at a second level that is different than the first level.

6. The display apparatus of claim 5, wherein the data driving part shifts the first to (N−1)-th data signals in a direction in which the first to N-th data lines are sequentially arranged.

7. The display apparatus of claim 4, wherein the data driving part outputs first to (N−2)-th data signals, where N is an integer greater than M, to third to N-th data lines of the data lines, respectively, when the driving mode selection signal is at a second level that is different from the first level.

8. The display apparatus of claim 4, wherein the data driving part outputs N-th to second data signals, where N is an integer greater than M, to (N−1)-th to first data lines of the plurality of data lines, respectively, when the driving mode selection signal is at a second level that is different from the first level.

9. The display apparatus of claim 8, wherein the data driving part shifts the N-th to second data signals in a direction opposite to a direction in which the first to N-th data lines are sequentially arranged.

10. A display apparatus comprising:

a display panel configured to display an image, and the display panel including a plurality of gate lines and a plurality of data lines;

a gate driving part configured to output gate signals to the plurality of gate lines; and a data driving part comprising a plurality of channels configured to output data signals to the plurality of data lines, and the plurality of channels further configured to shift the data signals by M channel, where M is a positive integer, according to a driving mode selection signal for selecting a driving mode of the display panel, wherein the data driving part comprises:

first to N-th channels configured to output first to N-th data signals of the data lines, where N is an integer greater than M; and normal driving switches disposed on the first to N-th channels, respectively, and configured to connect or disconnect the first to N-th channels.

11. The display apparatus of claim 10, wherein the data driving part further comprises shift driving switches disposed between first to (N−1)-th channels of the first to N-th channels, and second to N-th channels of the first to N-th channels, respectively.

12. The display apparatus of claim 11, wherein the data driving part further comprises:

a driving mode selection line configured to transfer the driving mode selection signal; and inverters disposed between the driving mode selection line and each of the shift driving switches.

13. The display apparatus of claim 12, wherein the normal driving switches are configured to be closed and the shift driving switches are configured to be opened when the driving mode selection signal is at a first level.

14. The display apparatus of claim 13, wherein the normal driving switches are configured to be opened and the shift driving switches are configured to be closed when the driving mode selection signal is at a second level that is different from the first level.

15. A method of testing a display apparatus, the method comprising:

operating a data driving part of a display panel in a normal driving mode in which data signals are output to data lines of the display panel configured to display an image;

operating the data driving part of the display panel in a shift driving mode in which the data signals are shifted by M channel prior to outputting the data signals, where M is a positive integer; and determining whether a defect present in the image displayed on the display panel is due to a fault of the display panel or is due to a fault of the data driving part which outputs the data signals to the display panel.

16. The method of claim 15, wherein, when the defect present in the image displayed on the display panel is determined to be due to the fault of the display panel, a position of the defect in the image does not change when the data driving part switches between the normal driving mode and the shift driving mode, and when the defect present in the image displayed on the display panel is determined to be due to the fault of the data driving part, the position of the defect in the image changes when the data driving part switches between the normal driving mode and the shift driving mode.

17. A method for testing a display apparatus, comprising:

operating a data driver of the display apparatus in a first mode in which data signals are provided to data lines of the display apparatus with a first correspondence;

determining a first location of a defect displayed in the display apparatus while operating the data driver in the first mode;

operating the data driver of the display apparatus in a second mode in which the data signals are provided to the data lines of the display apparatus with a second correspondence that is different from the first correspondence;

determining a second location of the defect displayed in the display apparatus while operating the data driver in the second mode; and determining whether a fault is present in the data driver or a display panel of the display apparatus based on whether the first location and the second location are identical to each other.

18. The method of claim 17, wherein it is determined that the fault is present in the data driver when the first location and the second location are different from each other and wherein it is determined that the fault is present in the display panel when the first location and the second location are identical to each other.

19. The method of claim 17, wherein the first correspondence connects a plurality of channels of the data driver with a plurality of data lines of the data lines, and the second correspondence changes the channel of the plurality of channels that each data line of the plurality of data lines is connected to.

20. The method of claim 19, wherein the second correspondence shifts the channel of the plurality of channels that each data line of the plurality of data lines is connected to by a number of channel M, where M is a positive integer.

* * * * *